US009962980B2

(12) United States Patent
Morie et al.

(10) Patent No.: US 9,962,980 B2
(45) Date of Patent: May 8, 2018

(54) THERMOSENSITIVE RECORDING MATERIAL

(71) Applicant: Oji Holdings Corporation, Tokyo (JP)

(72) Inventors: Masahiro Morie, Tokyo (JP); Takehiro Minami, Tokyo (JP); Kazuo Yamane, Tokyo (JP); Toshizo Yamamoto, Tokyo (JP); Kazuyuki Sakamoto, Tokyo (JP); Masaharu Nojima, Tokyo (JP)

(73) Assignee: OJI HOLDINGS CORPORATION, Tokyo (JP)

( * ) Notice: Subject to any disclaimer, the term of this patent is extended or adjusted under 35 U.S.C. 154(b) by 0 days. days.

(21) Appl. No.: 15/026,065

(22) PCT Filed: Sep. 30, 2014

(86) PCT No.: PCT/JP2014/075989

§ 371 (c)(1),
(2) Date: Mar. 30, 2016

(87) PCT Pub. No.: WO2015/050098

PCT Pub. Date: Apr. 9, 2015

(65) Prior Publication Data

US 2016/0236496 A1 Aug. 18, 2016

(30) Foreign Application Priority Data

| | | |
|---|---|---|
| Oct. 4, 2013 | (JP) | 2013-208748 |
| Feb. 13, 2014 | (JP) | 2014-025774 |
| Jul. 31, 2014 | (JP) | 2014-155776 |
| Jul. 31, 2014 | (JP) | 2014-155818 |
| Jul. 31, 2014 | (JP) | 2014-155832 |
| Jul. 31, 2014 | (JP) | 2014-155854 |
| Sep. 19, 2014 | (JP) | 2014-191137 |

(51) Int. Cl.

| | |
|---|---|
| ***B41M 5/42*** | (2006.01) |
| ***B41M 5/327*** | (2006.01) |
| ***B41M 5/337*** | (2006.01) |
| ***B41M 5/44*** | (2006.01) |

(Continued)

(52) U.S. Cl.

CPC ..... *B41M 5/3275* (2013.01); *B41M 5/3336* (2013.01); *B41M 5/3372* (2013.01); *B41M 5/3375* (2013.01); *B41M 5/423* (2013.01); *B41M 5/44* (2013.01); *B41M 5/323* (2013.01); *B41M 2205/04* (2013.01); *B41M 2205/20* (2013.01); *B41M 2205/28* (2013.01);

(Continued)

(58) Field of Classification Search

CPC ..... B41M 5/333; B41M 5/3336; B41M 5/42; B41M 5/423; B41M 5/44; B41M 2205/04; B41M 2205/36; B41M 2205/38; B41M 2205/40

USPC ..... 503/200–226

See application file for complete search history.

(56) References Cited

U.S. PATENT DOCUMENTS

| | | | | |
|---|---|---|---|---|
| 5,912,204 | A | 6/1999 | Yamada | |
| 6,579,829 | B2 * | 6/2003 | Nishimura | B41M 5/3336 106/31.18 |

(Continued)

FOREIGN PATENT DOCUMENTS

| | | |
|---|---|---|
| EP | 0 474 122 A2 | 3/1992 |
| JP | S60-002397 A | 1/1985 |
| JP | H05-4450 | 1/1993 |

(Continued)

OTHER PUBLICATIONS

International Search Report for International Application No. PCT/JP2014/075989 dated Nov. 18, 2014.

European Patent Application No. 14851026.6: Partial Supplementary European Search Report dated May 22, 2017.

Supplemental Extended European Search Report for corresponding European patent application No. 14851026.6 dated Sep. 20, 2017 (16 Sheets).

*Primary Examiner* — Bruce H Hess

(74) *Attorney, Agent, or Firm* — Kratz, Quintos & Hanson, LLP

(57) ABSTRACT

A main object of the present invention is to provide a thermosensitive recording material having excellent recording color developability and recording image quality, having no inhibition of a color-developing reaction due to the adhesive component after being processed into a thermosensitive recording label (glue desensitization), and being able to withstand long-term storage while retaining excellent recording performance. The present invention is a thermosensitive recording material (1) having at least an anchor layer (1) containing a sizing agent on a support, an undercoat layer containing at least one member selected from the group consisting of plastic hollow particles and sizing agents on the anchor layer (1), and a thermosensitive recording layer containing a leuco dye and a coloring agent on the undercoat layer; and is a thermosensitive recording material (2a) having an anchor layer (2) containing specific amounts of a pigment and a specific sizing agent on a support, and a thermosensitive recording layer containing a leuco dye and a coloring agent on the anchor layer (2); a thermosensitive recording material (2b) having an anchor layer (2) containing a pigment and a specific sizing agent on a support, and a thermosensitive recording layer containing a leuco dye and a specific coloring agent on the anchor layer (2); or a thermosensitive recording material (2c) having an anchor layer (2) containing a sizing agent and a water resistance-imparting agent on a support, and a thermosensitive recording layer containing a leuco dye and a coloring agent on the anchor layer.

20 Claims, No Drawings

(51) Int. Cl.
*B41M 5/333* (2006.01)
*B41M 5/323* (2006.01)

(52) U.S. Cl.
CPC ..... *B41M 2205/36* (2013.01); *B41M 2205/38* (2013.01); *B41M 2205/40* (2013.01)

(56) References Cited

U.S. PATENT DOCUMENTS

| | | | |
|---|---|---|---|
| 8,168,565 | B2 | 5/2012 | Kitano |
| 2009/0209419 | A1 | 8/2009 | Kitano |

FOREIGN PATENT DOCUMENTS

| | | | |
|---|---|---|---|
| JP | H05-58030 | | 3/1993 |
| JP | H07-179041 | | 7/1995 |
| JP | H07-205545 | | 8/1995 |
| JP | H08-039930 | A | 2/1996 |
| JP | H08-197846 | | 8/1996 |
| JP | H09-150576 | | 6/1997 |
| JP | H09-314711 | | 12/1997 |
| JP | 2001-246859 | A1 | 9/2001 |
| JP | 2004-284089 | A1 | 10/2004 |
| JP | 2007-223047 | A1 | 9/2007 |
| JP | 2009-190263 | A1 | 8/2009 |
| JP | 2009-255309 | A1 | 11/2009 |
| JP | 2011-062874 | A | 3/2011 |
| JP | 2012-101396 | A1 | 5/2012 |
| JP | 2012-245666 | A | 12/2012 |
| JP | 2013-22888 | A1 | 2/2013 |
| JP | 2013-132868 | A1 | 7/2013 |

* cited by examiner

THERMOSENSITIVE RECORDING MATERIAL

TECHNICAL FIELD

The present invention relates to a thermosensitive recording material that utilizes a color-developing reaction of a leuco dye with a coloring agent.

BACKGROUND ART

A thermosensitive recording material is typically formed by respectively grinding and dispersing an ordinary colorless or light-colored electron-donating leuco dye and an electron-accepting coloring agent such as a phenolic compound into fine particles, mixing both substances, adding an adhesive (binder), a filler such as a pigment, a sensitizer, and other lubricants and other auxiliary agents, and applying the obtained coating liquid to a sheet-like support such as paper, synthetic paper, or a plastic film. A thermosensitive recording material develops color due to an instantaneous chemical reaction caused by heating with a thermal head, a hot stamp, a thermal pen, a laser beam, or the like so as to obtain a recording image. Thermosensitive recording materials are widely used in facsimiles, computer terminal printers, automatic vending machines, measurement recorders, and the like. In recent years, there has been an increase in thermosensitive recording label applications in which the back surface of a label is subjected to adhesion processing. There is a long period of time until these POS labels or labels for process management agents are used after being subjected to adhesion processing. Therefore, components such as plasticizers, emulsifiers, low-molecular-weight oligomers, and surfactants contained in the adhesive agent applied to the back surface pass through the support and reach the thermosensitive recording surface at the time of storage. This causes the inhibition of a color-developing reaction (glue desensitization) and leads to problems in that the recording performance in terms of recording color developability or recording image quality is dramatically reduced or in that printing voids occur.

In order to solve the problems described above, it has been proposed to provide a barrier layer containing a polyvinyl alcohol with a high degree of saponification and a pigment between the support and the adhesive layer (see Patent Document 1); to provide a back coat layer containing a styrene-butadiene copolymer and a pigment on the back surface of the support (see Patent Document 2); to provide a back surface layer containing a water-soluble acrylic resin as a main component on the surface of the support on the side opposite to the thermosensitive recording layer (see Patent Document 3); and to add a styrene-acrylic-based resin having a glass transition point of at most 10° C. and a permeability of at most 2.0% at 280 nm in a 0.01 wt. % aqueous solution to the back coat layer (see Patent Document 4). However, satisfactory results have not yet necessarily been achieved.

In addition, an adhesive label for thermosensitive recording in which an adhesive undercoat layer containing a filler primarily composed of a thermoplastic resin between the back coat layer on the back surface of the support and the adhesive layer has also been proposed (see Patent Document 5). Furthermore, it has also been proposed to use a urea urethane compound such as 4,4'-bis[(4-methyl-3-phenoxycarbonylaminophenyl)ureido]diphenyl sulfone as a coloring agent (see Patent Document 6). However, these solutions have problems in that the inhibitory effect on poor coloring due to the adhesive component is insufficient or in that the production process becomes complex and the production efficiency decreases in order to achieve a sufficient effect.

In addition, woodfree paper is typically used as the support of a thermosensitive recording material. In the case of acidic paper making, paper is produced by adding a rosin-based sizing agent and a clay, talc, or the like as a filler. It is typical to use a sulfate band (aluminum sulfate) as a fixing agent of this rosin-based sizing agent, but the pH of the paper surface tends toward the acidic side due to residual sulfate radicals (sulfate ions) remaining in the paper. Therefore, the color-developing substance constituting the thermosensitive recording paper causes a reaction with acidic ions on the surface of the paper, which leads to a problem in that background fogging tends to occur during a long-term storage period. Neutral paper containing a basic pigment (alkaline filler) such as calcium carbonate may therefore be used as the support of a thermosensitive recording material for the purpose of preventing background fogging or reducing the paper making cost.

However, when a support containing a basic pigment is used as the support of the thermosensitive recording material, there are problems in that while the thermosensitive recording material is being stored, the coloring performance is diminished prior to recording, whereas printing is blurred and unclear or, in some cases, almost completely invisible due to discoloration after printing. In particular, when the color developability is diminished prior to recording, the printing density of the thermosensitive recording material is diminished, which makes the content difficult to decipher, dramatically diminishes the recording performance in terms of recording color developability and recording image quality that the material demonstrated prior to storage, and loses the original function as a thermosensitive recording material. The reason that the color developability is diminished is not clear, but is presumed to be due to the fact that the coloring agent forms a salt with the basic pigment (alkaline filler) contained in the support and causes a morphological change, which causes the performance of the coloring agent to be diminished.

In order to solve the problems described above, it has been proposed to use an alkyl ketene dimer as a synthetic sizing agent and to use neutral paper having a zeta potential of at most +20 mV in a solution of the synthetic sizing agent with a solid content concentration of 0.02% at a pH of 8.0 as a support (see Patent Document 7); and to provide a thermosensitive recording layer containing an alkali salt of a diosobutylene-maleic anhydride copolymer on neutral paper using an alkyl ketene dimer as a sizing agent (see Patent Document 8). However, satisfactory results have not yet necessarily been achieved.

CITATION LIST

Patent Literature

Patent Document 1: Japanese Unexamined Patent Application Publication No. H5-4450A Patent Document 2: Japanese Unexamined Patent Application Publication No. H9-150576A Patent Document 3: Japanese Unexamined Patent Application Publication No. 2004-284089A Patent Document 4: Japanese Unexamined Patent Application Publication No. 2009-255309A Patent Document 5: Japanese Unexamined Patent Application Publication No. 2009-190263A Patent Document 6: Japanese Unexamined Patent Application Publication No. 2001-246859A Patent Document 7: Japanese Unexamined Patent Application Publication No. H7-205545A Patent Document 8: Japanese Unexamined Patent Application Publication No. H8-197846A

SUMMARY OF INVENTION

Technical Problem

A main object of the present invention is to provide a thermosensitive recording material having excellent recording color developability and recording image quality, having no inhibition of a color-developing reaction due to the adhesive component after being processed into a thermosensitive recording label (glue desensitization), and being able to withstand long-term storage while retaining excellent recording performance.

Furthermore, another main object of the present invention is to provide a thermosensitive recording material having excellent blank-paper preservability even when the support contains a basic pigment.

Solution to Problem

As a result of conducting dedicated research, the present inventors discovered that the problems described above can be solved by providing an anchor layer containing a sizing agent and an undercoat layer containing at least one member selected from the group consisting of plastic hollow particles and sizing agents, by adding a specific sizing agent to the anchor layer, or by adding a sizing agent and a water resistance-imparting agent to the anchor layer, and the present inventors thereby completed the present invention. That is, the present invention relates to a thermosensitive recording material described below.

Item 1: A thermosensitive recording material comprising at least an anchor layer (1) containing a sizing agent on a support, an undercoat layer containing at least one member selected from the group consisting of plastic hollow particles and sizing agents on the anchor layer (1), and a thermosensitive recording layer containing a leuco dye and a coloring agent on the undercoat layer.

Item 2: The thermosensitive recording material according to item 1, wherein the undercoat layer contains the plastic hollow particles and the sizing agent.

Item 3: The thermosensitive recording material according to item 1 or 2, wherein the anchor layer (1) is a pigment-coated layer further containing a pigment.

Item 4: The thermosensitive recording material according to any one of items 1 to 3, wherein the sizing agent contained in the anchor layer (1) and/or the undercoat layer contains a sizing agent comprising a copolymer containing styrene as a main component.

Item 5: The thermosensitive recording material according to any one of items 1 to 4, wherein the sizing agent contained in the anchor layer (1) and/or the undercoat layer contains at least one member selected from the group consisting of styrene-acrylic-based sizing agents and styrene-maleic acid-based sizing agents.

Item 6: The thermosensitive recording material according to any one of items 1 to 5, wherein the anchor layer (1) contains a pigment and contains at least one member selected from the group consisting of oil-absorptive pigments and plastic hollow particles as the pigment, and the mass ratio of the oil-absorptive pigment to the plastic hollow particles in the anchor layer (1) is from 100/0 to 40/60.

Item 7: The thermosensitive recording material according to any one of items 1 to 6, wherein the anchor layer (1) contains the sizing agent in an amount of 1 to 9 mass % in terms of solids content, based on the total solids content of the anchor layer (1).

Item 8: The thermosensitive recording material according to any one of items 1 to 7, wherein the undercoat layer contains the sizing agent in an amount of 0.5 to 7 mass % in terms of solids content, based on the total solids content of the undercoat layer.

Item 9: The thermosensitive recording material according to any one of items 1 to 8, wherein the sizing agent in the anchor layer (1) contains a styrene-acrylic-based sizing agent.

Item 10: The thermosensitive recording material according to any one of items 1 to 9, wherein the sizing agent in the anchor layer (1) contains a styrene-acrylic-based emulsion-type sizing agent.

Item 11: The thermosensitive recording material according to any one of items 1 to 9, wherein the sizing agent in the undercoat layer contains a styrene-maleic anhydride-based sizing agent.

Item 12: The thermosensitive recording material according to any one of items 1 to 11, wherein the styrene-maleic anhydride sizing agent contains a butyl ester of a styrene-maleic anhydride copolymer.

Item 13: The thermosensitive recording material according to any one of items 1 to 12, wherein the undercoat layer contains the plastic hollow particles in an amount of 40 to 95 mass %, based on the total solids content of the undercoat layer.

Item 14: The thermosensitive recording material according to any one of items 1 to 13, wherein the anchor layer (1) contains at least one member selected from the group consisting of oil-absorptive pigments and plastic hollow particles as a pigment, and the mass ratio of the plastic hollow particles in the anchor layer (1) to the plastic hollow particles in the undercoat layer is from 0/100 to 60/40.

Item 15: The thermosensitive recording material according to any one of items 1 to 13, wherein the anchor layer (1) contains at least one member selected from the group consisting of oil-absorptive pigments and plastic hollow particles as a pigment, and the mass ratio of the plastic hollow particles in the anchor layer (1) to the plastic hollow particles in the undercoat layer is from 20/80 to 60/40.

Item 16: The thermosensitive recording material according to any one of items 1 to 13, wherein the anchor layer (1) contains plastic hollow particles as a pigment, and the mass ratio of the plastic hollow particles contained in the anchor layer (1) to the sizing agent comprising a copolymer containing styrene as a main component is, in terms of solids content, from 95/5 to 50/50.

Item 17; The thermosensitive recording material according to any one of items 1 to 16 comprising at least one member selected from the group consisting of 4,4'-dihydroxydiphenylsulfone, 2,4'-dihydroxydiphenylsulfone, and sulfonylurea compounds as the coloring agent.

Item 18: The thermosensitive recording material according to any one of items 1 to 17, comprising a protective layer containing a pigment and an adhesive on the thermosensitive recording layer.

Item 19: The thermosensitive recording material according to any one of Items 1 to 18, wherein the anchor layer (1) is formed by a blade coating method and is provided between the support and the thermosensitive recording layer.

Item 20: The thermosensitive recording material according to any one of items 1 to 19, wherein at least one layer that is formed on the support is formed by a curtain coating method.

Item 21: The thermosensitive recording material according to any one of items 1 to 20, wherein the support further contains a basic pigment.

Item 22: The thermosensitive recording material according to any one of items 1 to 21, wherein the support has an air permeability of 80 seconds or less.

Item 23: The thermosensitive recording material according to any one of items 1 to 22, wherein the support is a paper support.

Item 24: The thermosensitive recording material according to item 23, wherein the paper support is a neutral paper.

Item 25: The thermosensitive recording material according to any one of items 1 to 24, wherein the support has a surface roughness measured with a microtopograph under a pressure of 20 kg/cm$^2$ of at least 6 μm.

Item 26: The thermosensitive recording material according to any one of items 1 to 25, wherein the support has a Stockigt sizing degree of at most 15 seconds.

Item 27: The thermosensitive recording material according to any one of items 1 to 26, comprising an adhesive layer on a side of the support opposite to the thermosensitive recording layer side.

Item 28: The thermosensitive recording material according to any one of items 1 to 27, wherein at least the thermosensitive recording layer is a layer formed by a curtain coating method.

Item 29: A thermosensitive recording material comprising an anchor layer (2) containing a sizing agent on a support, and a thermosensitive recording layer containing a leuco dye and a coloring agent on the anchor layer (2);

2a) the anchor layer (2) further containing a pigment and containing at least one member selected from the group consisting of ammonium salts of styrene-maleic anhydride copolymers and ammonium salts of styrene-acrylic acid copolymers as the sizing agent contained in the anchor layer (2) in an amount of at least 0.5 parts by mass and less than 5 parts by mass per 100 parts by mass of the pigment contained in the anchor layer (2);

2b) the anchor layer (2) further containing a pigment and containing at least one member selected from the group consisting of anionic styrene-acrylic copolymer resins and styrene-maleic acid copolymer resins as the sizing agent, and containing N-[2-(3-phenylureide)phenyl]benzenesulfonamide as the coloring agent; or 2c) the anchor layer (2) further containing a water resistance-imparting agent.

Item 30: The thermosensitive recording material according to item 29, comprising a protective layer containing a pigment and an adhesive on the thermosensitive recording layer.

Item 31: The thermosensitive recording material according to item 29 or 30 in the form of the thermosensitive recording material (2b), wherein the sizing agent is contained in an amount of 0.1 to 1.0 parts by mass per 1 part by mass of the N-[2-(3-phenylureide)phenyl]benzenesulfonamide.

Item 32: The thermosensitive recording material according to any one of items 29 to 31, wherein the sizing agent is contained in an amount of 1 to 20 mass % of the total solids content of the anchor layer (2).

Item 33: The thermosensitive recording material according to any one of items 29 to 32, further comprising a urea urethane compound represented by the following general formula (1):

[Formula 1]

(1)

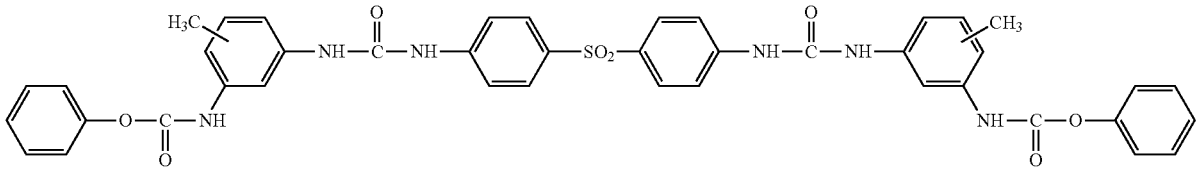

as the coloring agent.

Item 34: The thermosensitive recording material according to item 33 in the form of the thermosensitive recording material (2b), wherein the urea urethane compound represented by general formula (1) above is contained in an amount of 0.03 to 2.5 parts by mass per 1 part by mass of the N-[2-(3-phenylureide)phenyl]benzenesulfonamide.

Item 35: The thermosensitive recording material according to item 33 or 34, wherein the urea urethane compound represented by general formula (1) above is heat-treated in the same liquid as a basic inorganic pigment.

Item 36: The thermosensitive recording material according to item 35, wherein the basic inorganic pigment is at least one member selected from the group consisting of magnesium compounds, aluminum compounds, calcium compounds, titanium compounds, magnesium silicate, magnesium phosphate, and talc.

Item 37: The thermosensitive recording material according to any one of items 29 to 36, wherein the anchor layer (2) further contains plastic hollow particles.

Item 38: The thermosensitive recording material according to any one of items 29 to 37, wherein the anchor layer (2) is formed by a blade coating method and is provided between the support and the thermosensitive recording layer.

Item 39: The thermosensitive recording material according to any one of items 29 to 38, wherein at least one layer that is formed on the support is formed by a curtain coating method.

Item 40: The thermosensitive recording material according to any one of items 29 to 39, wherein the support further contains a basic pigment.

Item 41: The thermosensitive recording material according to any one of items 29 to 40, wherein the support has an air permeability of 80 seconds or less.

Item 42: The thermosensitive recording material according to any one of items 29 to 41, wherein the support is a paper support.

Item 43: The thermosensitive recording material according to item 42, wherein the paper support is a neutral paper.

Item 44: The thermosensitive recording material according to any one of items 29 to 43, wherein the support has a surface roughness measured with a microtopograph under a pressure of 20 kg/cm$^2$ of at least 6 μm.

Item 45: The thermosensitive recording material according to any one of items 29 to 44, wherein the support has a Stockigt sizing degree of at most 15 seconds.

Item 46: The thermosensitive recording material according to any one of items 29 to 45, comprising an adhesive layer on a side of the support opposite to the thermosensitive recording layer side.

Item 47: The thermosensitive recording material according to any one of items 29 to 46 in the form of the thermosensitive recording material (2c), wherein the sizing agent is contained, in terms of solids content, in an amount of 0.5 to 5 parts by mass per 1 part by mass of the water resistance-imparting agent.

Item 48: The thermosensitive recording material according to any one of items 29 to 47 in the form of the thermosensitive recording material (2c), wherein the water resistance-imparting agent is at least one member selected from the group consisting of aziridine compounds, blocked isocyanate compounds, dihydrazide carboxylate compounds, glyoxal, formalin, glycin, glycidyl esters, glycidyl ether, dimethylolurea, melamine resins, polyamide resins, polyamide polyamine-epichlorohydrin resins, ketone-aldehyde resins, ammonium persulfate, ferric chloride, magnesium chloride, zirconium ammonium carbonate salts, borax, boric acid, tetraboric acid soda, boric acid triesters, boron-based polymers, potassium tetraborate, zirconium ammonium carbonate, epoxy compounds, hydrazide compounds, oxazoline group-containing compounds, and glyoxylic acid salts.

Item 49: The thermosensitive recording material according to any one of items 29 to 48, wherein the anchor layer (2) is a pigment-coated layer further containing a pigment.

Item 50: The thermosensitive recording material according to any one of items 29 to 49 in the form of the thermosensitive recording material (2c), wherein the sizing agent contained in the anchor layer (2) is at least one member selected from the group consisting of styrene-acrylic-based sizing agents and styrene-maleic acid-based sizing agents.

Item 51: The thermosensitive recording material according to any one of items 29 to 50 in the form of the thermosensitive recording material (2c), wherein the anchor layer (2) further contains a pigment and contains at least one member selected from the group consisting of oil-absorptive pigments and plastic hollow particles as the pigment; and the mass ratio of the oil-absorptive pigment to the plastic hollow particles in the anchor layer (2) is from 100/0 to 40/60.

Item 52: The thermosensitive recording material according to any one of items 29 to 51 in the form of the thermosensitive recording material (2c), wherein the anchor layer (2) contains the sizing agent in an amount of 1 to 9 mass % in terms of solids content, based on the total solids content of the anchor layer (2).

Item 53: The thermosensitive recording material according to any one of items 29 to 52 in the form of the thermosensitive recording material (2c), wherein the anchor layer (2) contains a styrene-acrylic-based sizing agent.

Item 54: The thermosensitive recording material according to any one of items 29 to 53 in the form of the thermosensitive recording material (2c), wherein the anchor layer (2) contains a styrene-acrylic-based emulsion-type sizing agent.

Item 55: The thermosensitive recording material according to any one of items 29 to 54, wherein at least the thermosensitive recording layer is a layer formed by a curtain coating method.

Advantageous Effects of Invention

The thermosensitive recording material of the present invention has excellent recording color developability and recording image quality, has no inhibition of a color-developing reaction due to the adhesive component after being processed into a thermosensitive recording label (glue desensitization), and is able to withstand long-term storage while retaining excellent recording performance. Furthermore, the thermosensitive recording material of the present invention has excellent blank-paper preservability even when the support contains a basic pigment.

DESCRIPTION OF EMBODIMENTS

In the present specification, the expression "comprise" includes "comprise", "consisting essentially of", and "consisting of".

The present invention relates to a thermosensitive recording material comprising least an anchor layer (1) on a support, an undercoat layer on the anchor layer (1), and a thermosensitive recording layer on the undercoat layer (also described as "thermosensitive recording material (1)" hereafter), and a thermosensitive recording material comprising an anchor layer (2) and a thermosensitive recording layer on the anchor layer (2) on a support (also described as "thermosensitive recording material (2)" hereafter). The thermosensitive recording material (1) and the thermosensitive recording material (2) will be described in detail hereinafter.

1. Thermosensitive Recording Material (1)

The thermosensitive recording material (1) comprises at least an anchor layer (1) on a support, and an undercoat layer containing at least one member selected from the group consisting of plastic hollow particles and sizing agents on the anchor layer (1). This makes it possible to achieve excellent recording color developability and recording image quality. In addition, it is possible to prevent plasticizers, emulsifiers, or the like contained in the adhesive layer from penetrating the thermosensitive recording layer after being processed into a thermosensitive recording label, which yields excellent recording performance after long-term storage.

Furthermore, the thermosensitive recording material (1) has excellent blank-paper preservability even when a support containing a basic pigment is used.

1-1. Support

The support in the thermosensitive recording material (1) is not particularly limited, and examples include papers (paper supports) such as woodfree paper (acidic paper, neutral paper), medium-quality paper, coated paper, art paper, cast coated paper, and glassine paper; resin laminated paper, polyolefin-based synthetic paper, synthetic fiber paper, non-woven fabrics, synthetic resin films, transparent or translucent plastic films, and white plastic films.

In addition, either hardwood pulp or softwood pulp (softwood pulp obtained by a KP, SP, or AP method or the like) may be used as the fibers constituting the support. Examples of these pulps include chemical pulps such as leaf bleached kraft pulps (LBKP) and bleached softwood kraft pulps (NBKP), semi-chemical pulps (SCP), mechanical pulps such as ground pulps (GP) and thermomechanical pulps (TMP), various high-yield pulps, and recycled pulps such as paper deinking pulps (DIP). Glass fibers and various synthetic pulps may also be used in combination as necessary.

Examples of pigments typically contained in the support include organic pigments such as calcium carbonate, calcined kaolin, kaolin, diatomaceous earth, talc, chlorite, titanium oxide, barium sulfate, aluminum sulfate, and silica. In addition, of these inorganic pigments, the thermosensitive recording material (1) may contain a basic pigment which has a risk of diminishing the blank-paper preservability with respect to a specific coloring agent. Examples of basic pigments include calcium carbonate, barium carbonate, aluminum hydroxide, magnesium carbonate, magnesium silicate, and magnesium oxide. Herein, a basic pigment is a pigment which biases the pH of an aqueous solution in which the pigment is dissolved to the alkaline side.

When the support in the thermosensitive recording material (1) is neutral paper, the problems of the deterioration and background fogging in acidic paper can be solved, and a thermosensitive recording material using a specific coloring agent can be stored for a long period of time. The type and production method of the neutral paper are not particularly limited, but the neutral paper may be obtained by forming a paper from a pulp slurry containing pulp fibers and, typically, the basic pigments described above, for example, as fillers, alkyl ketene dimers (AKD), alkenyl succinic anhydride (ASA) or the like, rosin-based sizing agents such as reinforced rosin soaps and reinforced rosin emulsions, and so-called synthetic sizing agents such as alkenyl succinic acid soaps, and a polyamide, acrylamide, cationic starch, or the like as a stabilizer. The hot-water extraction pH (based on JIS P 8133) of this neutral paper is preferably in a range of approximately 6.0 to 11, more preferably in a range of 6.5 to 10, and even more preferably in a range of 7.5 to 10. By setting the pH of the neutral paper to at least 6.0, it is possible to effectively suppress background fogging at the time of blank paper storage. On the other hand, by setting the pH to at most 11, it is possible to effectively suppress the reduction in color developability after blank paper storage. In addition, it is possible to suppress the aggregation of the pulp slurry itself. Furthermore, the paper making performance can also be enhanced by adjusting the pH using a sulfuric acid band as necessary within a range in which the pH does not fall below 6.0. The pH of the acidic paper in the thermosensitive recording material (1) is in the range of at least pH 2 and less than pH 6 and is preferably in the range of approximately pH 2 to 5.7.

In the thermosensitive recording material (1), the air permeability of the support is preferably at most 80 seconds and more preferably at most 75 seconds. When a support having an air permeability greater than 80 seconds is used, it is difficult for substances to move inside the support, so although there is no risk of losing the recording performance of the coloring agent due to contact with a component that inhibits a color-developing reaction, there is a risk that the recording color developability may be diminished since heat is easily transmitted from the thermal head. In the thermosensitive recording material (1), providing a specific anchor layer (1) and an undercoat layer yields excellent barrier properties and makes it possible to use a support with a small air permeability. This yields excellent recording performance and blank-paper preservability. On the other hand, the lower limit of the air permeability is not particularly limited but is preferably at least approximately 10 seconds and more preferably at least approximately 15 seconds from the perspective of improving the coating suitability of the coating liquid when forming the anchor layer (1). When a support made of a paper support is used, the air permeability can typically be adjusted by changing, for example, the freeness of the pulp constituting the base paper, the ash content of fillers or the like. In order to adjust the air permeability to at most 80 seconds, it is preferable to set the C.S.F. freeness of the pulp to at least 400 mL. Herein, the air permeability is the Oken-type air permeability measured in accordance with JIS P 8117:2009.

The thickness of the support is not particularly limited but is ordinarily from approximately 20 to 200 μm.

Note that internal auxiliary agents for papermaking such as dyes, fluorescent brightening agents, pH adjusting agent, antifoaming agents, pitch control agents, and slime control agents may be added appropriately to the pulp slurry in accordance with the application of the paper. In addition, starch or the like may be applied during size pressing. A Fourdrinier paper machine, a twin-wire paper machine, a cylinder paper machine, a Yankee dryer paper machine, or the like may be used as needed as the paper making machine.

1-2. Anchor Layer (1) and Undercoat Layer

The sizing agent contained in the anchor layer (1) and the undercoat layer has strong water resistance of the film itself, and once it is dried, it will never dissolve again even when in contact with water. In the thermosensitive recording material (1), providing an intermediate layer having a multilayer structure comprising an anchor layer (1) and an undercoat layer between the support and the thermosensitive recording layer is thought to contribute to the uniform dispersion of the sizing agent and to enhance the barrier properties by bleeding the plastic hollow particles. As a result, components which inhibit color-developing reactions do not pass through the support, and the penetration of the anchor layer (1) by the coating liquid for the undercoat layer is suppressed. In addition, the penetration of the undercoat layer by the coating liquid for the thermosensitive recording layer is suppressed, and a uniform coating layer is formed so as to yield excellent recording performance. In addition, a multilayer structure between the support and the thermosensitive recording layer achieves an effect of reducing coloring unevenness originating from coating unevenness and improving the half-tone image quality in a single-layer structure.

Examples of the sizing agent in the thermosensitive recording material (1) include rosin-based sizing agents, alkyl ketene dimer sizing agents, alkenyl succinic anhydride, cation polymer sizing agents, rosin-based neutral sizing agents, styrene-acrylic-based sizing agents, olefin-based sizing agents, wax-based sizing agents, and styrene-maleic acid-based sizing agents. The sizing agent is typically called a sizing agent for paper production and has a hydrophilic group and a hydrophobic group in the molecular structure thereof. The form of the sizing agent may be a solution form or an emulsion form. These may be used alone or in a combination of two or more types. In the thermosensitive recording material (1), a styrene-acrylic-based sizing agent, for example, is a sizing agent comprising a copolymer of a styrene and an acryl as a main component.

In the thermosensitive recording material (1), an alkyl ketene dimer sizing agent, an olefin-based sizing agent, a wax-based sizing agent, or the like which is typically used as a surface sizing agent is preferable, and it is more preferable to use a synthetic resin-based sizing agent such as a styrene-acrylic-based sizing agent, an olefin-maleic acid-based sizing agent, or a styrene-maleic acid-based sizing agent. Of these, a sizing agent comprising a copolymer containing styrene as a main component is preferable. Styrene-maleic acid-based sizing agents include styrene-maleic anhydride-based sizing agents. Here, styrene-acrylic-based sizing agents also include styrene-acrylic acid copolymer salts, and examples of salts include sodium salts, potassium salts, ammonium salts, or combinations in which these salts coexist with one another. In addition, styrene-maleic anhydride-based sizing agents also include styrene-maleic anhydride copolymer salts, and examples of salts include sodium salts, potassium salts, ammonium salts, or combinations in which these salts coexist with one another. Furthermore, styrene-maleic anhydride-based sizing agents also include esters of styrene-maleic anhydride copolymers, and butyl esters of styrene-maleic anhydride copolymers are particularly preferable.

The sizing agent contained in the anchor layer (1) is not particularly limited but is preferably at least one member selected from the group consisting of styrene-acrylic-based sizing agents and styrene-maleic acid-based sizing agents, more preferably a styrene-acrylic-based sizing agent, and even more preferably a styrene-acrylic-based emulsion-type sizing agent. By using an emulsion-type sizing agent, it is possible to induce bleeding so as to form a film on top of the anchor layer (1) in the drying process of the anchor layer (1), and this enhances the coatability with respect to a support with a rough surface, which is thought to yield excellent recording color developability and recording image quality and excellent recording performance by suppressing the inhibition of color-developing reactions (glue desensitization) due to the adhesive component after being processed into a thermosensitive recording label.

The content of the sizing agent in the anchor layer (1) is, in terms of solids content, preferably from approximately 1 to 9 mass %, more preferably from approximately 2 to 8 mass %, and even more preferably from approximately 2.5 to 5 mass % of the total solids content of the anchor layer (1). By setting the content of the sizing agent to at least 1 mass %, it is possible to sufficiently withstand long-term storage after being processed into a thermosensitive recording label, to increase the recording color developability and to enhance the recording image quality. On the other hand, by setting the content of the sizing agent to at most 9 mass %, it is possible to increase the recording color developability and to enhance the sensitivity of the thermosensitive recording layer.

The anchor layer (1) of the thermosensitive recording material (1) may also contain other aqueous resins, auxiliary agents, or the like as long as the effect of the present invention is not diminished. Examples of other aqueous resins include polyvinyl alcohol, modified polyvinyl alcohol, starch, oxidized starch, modified starch, starch-vinyl acetate graft copolymers, casein, gelatin, polyacrylamide, polyamide, hydroxyethyl cellulose, methyl cellulose, carboxymethyl cellulose, styrene-butadiene-based latex, polyurethane-based latex, and acrylic-based latex. Two types of these other aqueous resins may be used in combination, and the total content thereof is not particularly limited but is preferably from approximately 5 to 30 mass %, more preferably from approximately 8 to 20 mass %, and even more preferably from approximately 10 to 20 mass % of the total solids content of the anchor layer (1). The thermosensitive recording material (1) preferably does not contain starches from the perspective of the pot life in that the viscosity of the coating liquid decreases over time.

Examples of auxiliary agents include dispersants such as sodium dioctyl sulfosuccinate, sodium dodecyl benzenesulfonate, sodium lauryl sulfate alcohol esters, and fatty acid metal salts; water resistance-imparting agents such as aziridine compounds, blocked isocyanate compounds, dihydrazide carboxylate-based compounds such as dihydrazide adipate, glyoxal, formalin, glycin, glycidyl esters, glycidyl ether, dimethylolurea, melamine resins, polyamide resins, polyamide polyamine-epichlorohydrin resins, ketone-aldehyde resins, ammonium persulfate, ferric chloride, magnesium chloride, zirconium ammonium carbonate salts, borax, boric acid, tetraboric acid soda, boric acid triesters, boron-based polymers, potassium tetraborate, zirconium ammonium carbonate, epoxy compounds, hydrazide compounds, oxazoline group-containing compounds, and glyoxylic acid salts such as sodium glyoxylate, calcium di(glyoxylate), and ammonium glyoxylate; and antifoaming agents. Note that the water resistance-imparting agent is preferably used in an amount in the range of 0.1 to 10 mass % and more preferably from approximately 1 to 5 mass % of the total solids content of the anchor layer (1).

The anchor layer (1) is preferably a pigment-coated layer containing a pigment. By containing a pigment, it is possible to improve the recording color developability and the recording image quality by eliminating irregularities on the surface of the support with a rough surface. In addition, it is possible to improve the coatability by suppressing the penetration of the support by the sizing agent contained in the anchor layer (1), and to increase the recording performance by suppressing the inhibition of color-developing reactions (glue desensitization) due to the adhesive component after being processed into a thermosensitive recording label.

In the case of base paper obtained by surface size treatment such as size pressing, for example, the sizing agent is typically distributed along the thickness direction of the paper, so the distribution of the sizing agent in the vicinity of the paper surface is low. By forming the anchor layer of the present invention on the support, it is possible to allow the sizing agent to be present uniformly on the support. By further providing an undercoat layer, it is possible to enhance the half-tone image quality.

The pigment contained in the anchor layer (1) is not particularly limited but is preferably an oil-absorptive pigment and/or plastic hollow particles and/or heat-expansible particles having an oil absorption of at least 70 mL/100 g and particularly preferably from approximately 80 to 150 mL/100 g. Herein, the oil absorption is a value determined in accordance with the method of JIS K 5101.

Various pigments can be used as the oil-absorptive pigment contained in the anchor layer (1), and specific examples include inorganic pigments such as calcined kaolin, amorphous silica, precipitated calcium carbonate, and talc. Of these, calcined kaolin is preferable from the perspective of enhancing the recording performance. The average particle size of the primary particles of these oil-absorptive pigments is preferably from approximately 0.01 to 5 μm and particularly preferably from approximately 0.02 to 3 μm. The content of the oil-absorptive pigment is not particularly limited but is preferably from approximately 2 to 90 mass %, more preferably from approximately 5 to 90 mass %, and even more preferably from approximately 30 to 80 mass % of the total solids content of the anchor layer (1).

Examples of the plastic hollow particles contained in the anchor layer (1) include conventionally known plastic hollow particles such as particles in which the film material is formed from acrylic resin, styrene resin, or vinylidene chloride resin and which have a hollow ratio of approximately 50 to 99%. Herein, the hollow ratio is a value determined by the following formula: $(d/D)\times 100$. In the formula, d is the inside diameter of the plastic hollow particles, and D is the outside diameter of the plastic hollow particles. The average particle size of the plastic hollow particles is preferably from approximately 0.5 to 10 μm and more preferably from approximately 1 to 3 μm. The content of the plastic hollow particles is not particularly limited but is preferably from approximately 2 to 90 mass %, more preferably from approximately 5 to 70 mass %, and even more preferably from approximately 10 to 50 mass % of the total solids content of the anchor layer (1).

In the thermosensitive recording material (1), the anchor layer (1) preferably contains an oil-absorptive pigment and more preferably contains an oil-absorptive pigment and plastic hollow particles. The oil-absorptive pigment and the plastic hollow particles are used within the ranges of the contents described above, and the total content of the oil-absorptive pigment and the plastic hollow particles is preferably from approximately 5 to 93 mass % and more preferably from approximately 10 to 85 mass % of the total solids content of the anchor layer (1).

In the thermosensitive recording material (1), the mass ratio of the oil-absorptive pigment to the plastic hollow particles in the anchor layer (1) is preferably in the range of 100/0 to 40/60, more preferably in the range of 90/10 to 60/40, and even more preferably in the range of 85/15 to 70/30. By setting the mass ratio of the oil-absorptive pigment to at most 100, it is possible to increase the cushioning of the anchor layer (1) and to enhance the recording color developability and the recording image quality. On the other hand, by setting the mass ratio to at least 40, it is possible to sufficiently express the oil-absorptive capacity of the anchor layer (1) and to enhance the recording image quality by reducing image defects due to head residues or the like. In addition, when the mass ratio is within this range, it is possible to further enhance the barrier properties and to enable the material to sufficiently withstand long-term storage after being processed into a thermosensitive recording label.

The anchor layer (1) is typically formed on the support by applying a coating liquid for the anchor layer (1) prepared by using water as a dispersion medium and mixing a sizing agent and, if necessary, a pigment, other aqueous resins, auxiliary agents, and the like, and drying the coating liquid. The coated amount of the anchor layer (1) is not particularly limited but is preferably from approximately 3 to 20 g/m$^2$ and more preferably from approximately 5 to 15 g/m$^2$ in terms of dry weight.

In the thermosensitive recording material (1), an undercoat layer is provided on the anchor layer (1). The undercoat layer in the thermosensitive recording material (1) contains plastic hollow particles and a sizing agent. The plastic hollow particles and the sizing agent contained in the undercoat layer are not particularly limited and can be selected appropriately from the substances that can be used in the anchor layer (1), for example. The sizing agent may be the same or different for both the anchor layer (1) and the undercoat layer.

The sizing agent contained in the undercoat layer is not particularly limited but is preferably at least one member selected from the group consisting of styrene-acrylic-based sizing agents and styrene-maleic acid-based sizing agents, more preferably a styrene-maleic anhydride-based sizing agent, and even more preferably a butyl ester of a styrene-maleic anhydride copolymer. This increases the synergistic effect with the plastic hollow particles and yields excellent recording performance by suppressing the inhibition of color-developing reactions (glue desensitization) due to the adhesive component after being processed into a thermosensitive recording label.

The content of the plastic hollow particles in the undercoat layer is preferably from approximately 40 to 95 mass %, more preferably from approximately 45 to 85 mass %, and even more preferably from approximately 70 to 85 mass % of the total solids content of the undercoat layer. By setting the content to at least 40 mass %, it is possible to increase the heat insulation and to enhance the recording color developability and the recording image quality. On the other hand, by setting the content to at most 95 mass %, it is possible to prevent decreases in image quality in which the heat insulation becomes too high so that the thermosensitive printed content bleeds.

In the thermosensitive recording material (1), the anchor layer (1) contains at least one member selected from the group consisting of oil-absorptive pigments and plastic hollow particles as a pigment, and the mass ratio of the plastic hollow particles in the anchor layer (1) to the plastic hollow particles in the undercoat layer is preferably in the range of 0/100 to 60/40 and more preferably in the range of 20/80 to 60/40. When the mass ratio is within this range, it is possible to yield an excellent balance of the barrier properties and coatability of the anchor layer (1) and the undercoat layer due to the synergistic effect with the sizing agent, which makes it possible to enhance the recording color developability and the recording image quality and to impart recording performance so that the material can sufficiently withstand long-term storage after being processed into a thermosensitive recording label.

The content of the sizing agent in the undercoat layer is, in terms of solids content, preferably from approximately 0.5 to 7 mass %, more preferably from approximately 2.5 to 6.5 mass %, and even more preferably from approximately 2.5 to 4.5 mass % of the total solids content of the undercoat layer. By setting the content to at least 0.5 mass %, it is possible to sufficiently withstand long-term storage after being processed into a thermosensitive recording label, and to enhance the recording color developability and the recording image quality. By setting the content to at most 7 mass %, it is possible to increase the recording color developability and to enhance the sensitivity of the thermosensitive recording layer.

In the thermosensitive recording material (1), adjusting the coated amount of all of the sizing agents and plastic hollow particles contained in the anchor layer (1) and the undercoat layer makes it possible to effectively form a multilayer structure comprising an anchor layer (1) and an undercoat layer. This coated amount is, in terms of solids content, preferably from approximately 3 to 30 parts by mass of all of the sizing agents per 100 parts by mass of all of the plastic hollow particles. The coated amount is more preferably from approximately 5 to 25 parts by mass and even more preferably from approximately 6.0 to 17 parts by mass. By setting the coated amount to at least 3 parts by mass, it is possible to sufficiently withstand long-term storage after being processed into a thermosensitive recording label, and it is possible to enhance the recording color developability and the recording image quality. On the other hand, by setting the coated amount to at most 30 parts by mass, it is possible to increase the recording color developability and to enhance the sensitivity of the thermosensitive recording layer.

The undercoat layer of the thermosensitive recording material (1) may also contain other aqueous resins, other pigments other than plastic hollow particles, auxiliary agents, or the like as long as the effect of the present invention is not diminished. The other aqueous resins and auxiliary agents are not particularly limited and may be selected appropriately from the substances that can be used in the anchor layer (1), for example. Examples of pigments include organic pigments such as urea, phenol, epoxy, styrene, nylon, polyethylene, melamine, benzoguanamine resins, and urea-formalin-based resins, and inorganic pigments such as calcined kaolin, silicic acid, porous calcium carbonate, talc, kaolin, calcium carbonate, magnesium carbonate, zinc oxide, titanium oxide, aluminum silicate, calcium silicate, and aluminum hydroxide.

The undercoat layer is typically formed on the anchor layer (1) by applying a coating liquid for the undercoat layer prepared by using water as a dispersion medium and mixing a plastic hollow particles, and sizing agent, and, if necessary, other pigments, aqueous resins, auxiliary agents, and the like, and drying the coating liquid. The coated amount of the undercoat layer is not particularly limited but is preferably from approximately 0.5 to 10 g/m$^2$ and more preferably from approximately 1 to 5 g/m$^2$ in terms of dry weight.

1-3. Thermosensitive Recording Layer

The thermosensitive recording layer of the thermosensitive recording material (1) may contain various known leuco dyes and coloring agents. The thermosensitive recording layer may also contain sensitizers, storage stability improving agent, pigments, various auxiliary agents, and the like as necessary. This thermosensitive recording layer is provided on the undercoat layer.

Specific examples of leuco dyes include blue color developing dyes such as 3,3-bis(p-dimethylaminophenyl)-6-dimethylaminophthalide, 3-(4-diethylamino-2-methylphenyl)-3-(4-dimethylaminophenyl)-6-dimethylaminophthalide, and fluoran; green color developing dyes such as 3-(N-ethyl-N-p-tolyl)amino-7-N-methylanilinofluoran, 3-diethylamino-7-anilinofluoran, 3-diethylamino-7-dibenzylaminofluoran, and rhodamine B-anilinolactam; red color developing dyes such as 3,6-bis(diethylamino)fluoran-γ-anilinolactam, 3-cyclohexylamino-6-chlorofluoran, 3-diethylamino-6-methyl-7-chlorofluoran, and 3-diethylamino-7-chlorofluoran; black color developing dyes such as 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-(N-ethyl-N-isoamylamino)-6-methyl-7-anilinofluoran, 3-diethylamino-7-(m-trifluoromethylanilino)fluoran, 3-(N-isoamyl-N-ethylamino)-7-(o-chloroanilino)fluoran, 3-(N-ethyl-N-2-tetrahydrofurfurylamino)-6-methyl-7-anilinofluoran, 3-(N-n-hexyl-N-ethylamino)-6-methyl-7-anilinofluoran, 3-[N-(3-ethoxypropyl)-N-ethylamino]-6-methyl-7-anilinofluoran, 3-[N-(3-ethoxypropyl)-N-methylamino]-6-methyl-7-anilinofluoran, 3-diethylamino-7-(2-chloroanilino)fluoran, 3-di(n-butylamino)-7-(2-chloroanilino)fluoran, 4,4'-bis-dimethylaminobenzohydrine benzyl ether, N-2,4,5-trichlorophenyl leucoauramine, 3-diethylamino-7-butylaminofluoran, 3-ethyltolylamino-6-methyl-7-anilinofluoran, 3-cyclohexylmethylamino-6-methyl-7-anilinofluoran, 3-diethylamino-6-chloro-7-(β-ethoxyethyl)aminofluoran, 3-diethylamino-6-chloro-7-(γ-chloropropyl)aminofluoran, 3-diethylamino-6-methyl-7-anilinofluoran, 3-(N-isoamyl-N-ethylamino)-6-methyl-7-anilinofluoran, 3-dibutylamino-7-chloroanilinofluoran, 3-diethylamino-7-(o-chlorophenylamino)fluoran, 3-(N-ethyl-p-toluidino)-6-methyl-7-anilinofluoran, 3-(N-ethyl-p-toluidino)-6-methyl-7-(p-toluidino)fluoran, 3-(N-ethyl-N-tetrahydrofurfurylamino)-6-methyl-7-anilinofluoran, 3-diethylamino-6-chloro-7-anilinofluoran, 3-dimethylamino-6-methyl-7-anilinofluoran, 3-pyrrolidino-6-methyl-7-anilinofluoran, 3-piperidino-6-methyl-7-anilinofluoran, 2,2-bis{4-[6'-(N-cyclohexyl-N-methylamino)-3'-methylspiro[phthalide-3,9'-xanthen-2'-ylamino]phenyl}propane, and 3-diethylamino-7-(3'-trifluoromethylphenyl)aminofluoran; dyes having an absorption wavelength in the near infrared region such as 3,3-bis[1-(4-methoxyphenyl)-1-(4-dimethylaminophenyl)ethylen-2-yl]-4,5,6,7-tetrachlorophthalide, 3,3-bis[1-(4-methoxyphenyl)-1-(4-pyrrolidinophenyl)ethylen-2-yl]-4,5,6,7-tetrachlorophthalide, 3-p-(p-dimethylaminoanilino)anilino-6-methyl-7-chlorofluoran, 3-p-(p-chloroanilino)anilino-6-methyl-7-chlorofluoran, and 3,6-bis(dimethylamino)fluorene-9-spiro-3'-(6'-dimethylamino)phthalide; and the like. Of course, the leuco dye is not limited to these and, as necessary, two or more types of leuco dyes may be used in combination. Among these, 3-di(n-butyl)amino-6-methyl-7-anilinofluoran, 3-di(n-pentyl)amino-6-methyl-7-anilinofluoran, and 3-(N-ethyl-N-isoamylamino)-6-methyl-7-anilinofluoran are preferably used due to excellent color development sensitivity and print storage stability. The content of the leuco dye is not particularly limited and is preferably from approximately 3 to 30 mass %, more preferably from approximately 5 to 25 mass %, and even more preferably from approximately 7 to 20 mass % of the total solids content of the thermosensitive recording layer. By setting the content to at least 3 mass %, the color developability can be enhanced to improve the printing density. By setting the content to at most 30 mass %, the heat resistance can be enhanced.

Specific examples of coloring agents include phenolic compounds such as 4-tert-butylphenol, 4-acetylphenol, 4-tert-octylphenol, 4,4'-sec-butylidenediphenol, 4-phenylphenol, 4,4'-dihydroxydiphenylmethane, 4,4'-isopropylidenediphenol, 4,4'-cyclohexylidenediphenyl, 4,4'-cyclohexylidenediphenol, 1,1-bis(4-hydroxyphenyl)-ethane, 1,1-bis(4-hydroxyphenyl)-1-phenylethane, 4,4'-bis(p-tolylsulfonylaminocarbonylamino)diphenylmethane, 1,1-bis(4-hydroxyphenyl)cyclohexane, 2,2'-bis[4-(4-hydroxyphenyl)phenoxy]diethyl ether, 4,4'-dihydroxydiphenylsulfide, 4,4'-thiobis(3-methyl-6-tert-butylphenol), 4,4'-dihydroxydiphenylsulfone, 2,4'-dihydroxydiphenylsulfone, 2,2-bis(4-hydroxyphenyl)-4-methylpentane, 2,4'-dihydroxydiphenylsulfone, 4-hydroxy-4'-isopropoxydiphenylsulfone, 4-hydroxy-4'-n-propoxydiphenylsulfone, 4-hydroxy-4'-allyloxydiphenylsulfone, 4-hydroxy-4'-benzyloxydiphenylsulfone, 3,3'-diallyl-4,4'-dihydroxydiphenylsulfone, butyl bis(p-hydroxyphenyl)acetate, methyl bis(p-hydroxyphenyl)acetate, hydroquinone monobenzyl ether, bis(3-allyl-4-hydroxyphenyl)sulfone, 4-hydroxy-4'-methyldiphenylsulfone, 4-allyloxy-4'-hydroxydiphenylsulfone, and 3,4-dihydroxyphenyl-4'-methylphenylsulfone; phenolic compounds such as 4-hydroxybenzophenone, dimethyl 4-hydroxyphthalate, methyl 4-hydroxybenzoate, propyl 4-hydroxybenzoate, sec-butyl 4-hydroxybenzoate, phenyl 4-hydroxybenzoate, benzyl 4-hydroxybenzoate, benzyl 4-hydroxybenzoate ester, tolyl 4-hydroxybenzoate, chlorophenyl 4-hydroxybenzoate, and 4,4'-dihydroxydiphenyl ether; aromatic carboxylic acids such as benzoic acid, p-chlorobenzoic acid, p-tert-butylbenzoic acid, tolylchlorobenzoic acid, terephthalic acid, salicylic acid, 3-tert-butylsalicylic acid, 3-isopropylsalicylic acid, 3-benzylsalicylic acid, 3-(α-methylbenzyl)salicylic acid, 3,5-di-tert-butylsalicylic acid, 4-[2-(p-methoxyphenoxy)ethyloxy]salicylic acid, 4-[3-(p-tolylsulfonyl)propyloxy]salicylic acid, 5-[p-(2-p-methoxyphenoxyethoxy) cumyl]salicylic acid, and zinc 4-{3-(p-tolylsulfonyl) propyloxy]salicylate; salts of these phenolic compounds and aromatic carboxylic acids and, for example, polyvalent metals such as zinc, magnesium, aluminum, calcium, titanium, manganese, tin, and nickel; antipyrine complexes of zinc thiocyanate; organic acidic substances such as composite zinc salts of terephthalic aldehyde acid and other aromatic carboxylic acids; urea compounds such as N-p-toluenesulfonyl-N'-3-(p-toluenesulfonyloxy)phenylurea, N-p-toluenesulfonyl-N'-p-butoxycarbonylphenylurea, N-p-tolylsulfonyl-N'-phenylurea, 4,4'-bis(p-toluenesulfonylaminocarbonylamino)diphenylmethane, and 4,4'-bis[(4-methyl-3-phenoxycarbonylaminophenyl)ureido] diphenylsulfone; thiourea compounds such as N,N'-di-m-chlorophenylthiourea; organic compounds having —$SO_2$NH— bonds in the molecule such as p-cumylphenyl N-(p-toluenesulfonyl)carbamoylate ester, p-benzyloxyphenyl N-(p-toluenesulfonyl)carbamoylate ester, N-[2-(3-phenylureido)phenyl]benzenesulfonamide, and N-(o-toluoyl)-p-toluenesulfoamide; and inorganic acidic substances such as activated clay, attapulgite, colloidal silica, and aluminum silicate.

Additional examples include urea urethane derivatives such as 4,4'-bis[(4-methyl-3-phenoxycarbonylaminophenyl) ureido]diphenylsulfone, 4,4'-bis[(2-methyl-5-phenoxycarbonylaminophenyl)ureido]diphenylsulfone, and 4-(2-methyl-3-phenoxycarbonylaminophenyl)ureido-4'-(4-methyl-5-phenoxycarbonylaminophenyl) ureidodiphenylsulfone represented by general formula (1) below, and diphenylsulfone derivatives represented by general formula (2) below. These coloring agents may be used alone or in a combination of two or more types.

blank-paper preservability when a support containing a basic pigment is used, but since the anchor layer (1) and the undercoat layer are provided in the thermosensitive recording material (1), it is possible to suppress the inhibition of color-developing reactions (glue desensitization) due to the adhesive component after being processed into a thermosensitive recording label and to enhance the blank-paper preservability, so the coloring agents can be used suitably.

The content of the coloring agent is not particularly limited and may be adjusted in accordance with the leuco dye that is used, but the content is typically preferably at least 0.5 parts by mass, more preferably at least 0.8 parts by mass, even more preferably at least 1 part by mass, even more preferably at least 1.2 parts by mass, and particularly preferably at least 1.5 parts by mass per 1 part by mass of the leuco dye. In addition, the content of the coloring agent is preferably at most 10 parts by mass, more preferably at most 5 parts by mass, even more preferably at most 4 parts by mass, and particularly preferably at most 3.5 parts by mass per 1 part by mass of the leuco dye. By setting the content to at least 0.5 parts by mass, it is possible to increase the recording performance. On the other hand, by setting the content to at most 10 parts by mass, it is possible to effectively suppress background fogging in high-temperature environments.

The thermosensitive recording layer may also contain a sensitizer as necessary. As a result, the recording sensitivity can be enhanced. Examples of sensitizers include myristic acid amide, palmitic acid amide, stearic acid amide, arachidic acid amide, methoxycarbonyl-N-stearic acid benzamide, N-benzoyl stearic acid amide, N-eicosanoic acid amide, ethylenebisstearic acid amide, behenic acid amide, methylenebisstearic acid amide, N-methylol stearic acid

[Formula 2]

(1)

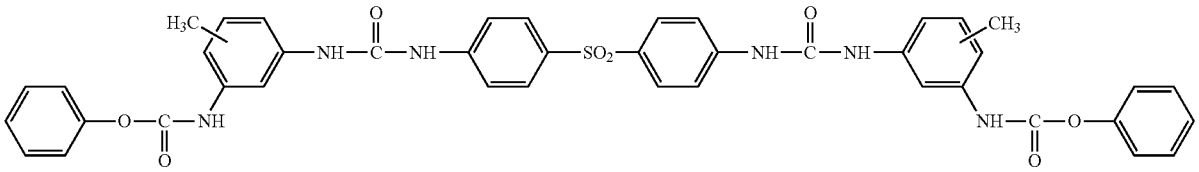

[Formula 3]

(2)

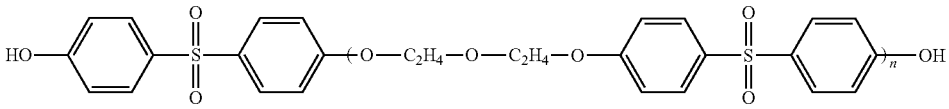

(In the formula, n is an integer of 1 to 6.)

The thermosensitive recording layer of the thermosensitive recording material (1) preferably contains at least one member selected from the group consisting of 4,4'-dihydroxydiphenylsulfone, 2,4'-dihydroxydiphenylsulfone, and sulfonylurea compounds as a coloring agent. Examples of sulfonylurea compounds include 4,4'-bis(3-tocylureido)diphenylmethane, 1,5-(3-oxopentylene)-bis(3-(3'-(p-toluenesulfonyl)ureido)benzoate, 1-(4-butoxycarbonylphenyl)-3-tocylurea, N-(p-toluenesulfonyl)-N'-phenylurea, N-(p-toluenesulfonyl)-N'-p-tolylurea, N-p-tolylsulfonyl-N'-3-(p-tolylsulfonyloxyphenylurea, 4,4'-bis(3-(tocyl)ureido) diphenyl ether, and 4,4'-bis(3-tocyl)ureido)diphenylsulfone. These specific coloring agents cause a large decrease in amide, dibenzyl terephthalate, dimethyl terephthalate, dioctyl terephthalate, benzyl p-benzyloxybenzoate, phenyl 1-hydroxy-2-naphthoate, benzyl 2-naphthyl ether, m-terphenyl, dibenzyl oxalate, di-p-methylbenzyl oxalate, di-p-chlorobenzyl oxalate, dibenzyl oxalate ester, p-benzylbiphenyl, tolyl biphenyl ether, p-tolyl biphenyl ether, di(p-methoxyphenoxyethyl)ether, 1,2-di(3-methylphenoxy)ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(2-methylphenoxy)ethane, 1-(4-methoxyphenoxy)-2-(3-methylphenoxy)ethane, p-methylthiophenylbenzylether, 1,4-di(phenylthio)butane, p-acetotoluidide, p-acetophenetidide, N-acetoacetyl-p-toluidine, di((3-biphenylethoxy)benzene, p-di(vinyloxyethoxy)benzene, 1-isopropylphenyl-2-phenylethane, diphenylsulfone, and 1,2-diphenoxymethylbe. These sensitizers may be used in combination in a range that does not cause troubles. Of these, stearic acid amide, diphenylsulfone, 2-naphthylbenzyl ether, di-p-chlorobenzyl oxalate ester, di-p-methylbenzyl oxalate ester, 1,2-di(3-methylphenoxy)ethane, and 1,2-diphenoxyethane are preferably used in that they have excellent color development sensitivity. The content of the sensitizer is not particularly limited but is typically preferably adjusted within a range of at most approximately 4 parts by mass per 1 part by mass of the coloring agent, and the content is preferably from approximately 2 to 40 mass % and more preferably from approximately 5 to 25 mass % of the total solids content of the thermosensitive recording layer.

The thermosensitive recording layer may also contain a storage stability improving agent as necessary. As a result, the storage stability of the recorded part can be enhanced. Examples of storage stability improving agents include hindered phenol compounds such as 2,2'-methylenebis(4-methyl-6-tert-butylphenol), 2,2'-ethylenebis(4-methyl-6-tert-butylphenol), 2,2'-methylenebis(4-ethyl-6-tert-butylphenol), 2,2'-methylenebis(4,6-di-tert-butylphenol), 2,2'-ethylidenebis(4,6-di-tert-butylphenol), 2,2'-ethylidenebis(4-methyl-6-tert-butylphenol), 2,2'-ethylidenebis(4-ethyl-6-tert-butylphenol), 2,2'-(2,2-propylidene)bis(4,6-di-tert-butylphenol), 2,2'-methylenebis(4-methoxy-6-tert-butylphenol), 2,2'-methylenebis(6-tert-butylphenol), 4,4'-thiobis(3-methyl-6-tert-butylphenol), 4,4'-thiobis(2-methyl-6-tert-butylphenol), 4,4'-thiobis(5-methyl-6-tert-butylphenol), 4,4'-thiobis(2-chloro-6-tert-butylphenol), 4,4'-thiobis(2-methoxy-6-tert-butylphenol), 4,4'-thiobis(2-ethyl-6-tert-butylphenol), 4,4'-butylidenebis(6-tert-butyl-m-cresol), 1-[α-methyl-α-(4'-hydroxyphenyl)ethyl]-4-[α',α'-bis(4"-hydroxyphenyl)ethyl]benzene, 1,1,3-tris(2-methyl-4-hydroxy-5-tert-cyclohexylphenyl)butane, 1,1,3-tris(2-methyl-4-hydroxy-5-tert-butylphenyl)butane, 4,4'-thiobis(3-methylphenol), 4,4'-dihydroxy-3,3',5,5'-tetrabromodiphenylsulfone, 4,4'-dihydroxy-3,3',5,5'-tetramethyldiphenylsulfone, 2,2-bis(4-hydroxy-3,5-dibromophenyl)propane, 2,2-bis(4-hydroxy-3,5-dichlorophenyl)propane, 2,2-bis(4-hydroxy-3,5-dimethylphenyl)propane, and tris(2,6-dimethyl-4-tertiary butyl-3-hydroxybenzyl)isocyanurate; epoxy compounds such as 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol novolac-type epoxy resins, phenol novolac-type epoxy resins, and bisphenol A-type epoxy resins; N,N'-di-2-naphthyl-p-phenylenediamine; bis(4-ethyleneiminocarbonylaminophenyl)methane; 2,2'-methylenebis(4,6-di-tert-butylphenyl)phosphate soda; sodium salts or polyvalent metal salts of N,N'-di-2-naphthyl-p-phenylenediamine or 2,2'-methylenebis(4,6-di-tert-butylphenyl)phosphate; and bis(4-ethyleneiminocarbonylaminophenyl)methane.

The content of the storage stability improving agent may be an effective amount for improving storage stability, but the content is typically preferably from approximately 1 to 30 mass % and more preferably from approximately 5 to 20 mass % of the total solids content of the thermosensitive recording layer.

Specific examples of the pigment contained in the thermosensitive recording layer include inorganic pigments such as kaolin, clay, talc, calcine kaolin, calcium carbonate, magnesium carbonate, aluminum oxide, aluminum hydroxide, magnesium hydroxide, magnesia, zinc oxide, titanium oxide (titanium dioxide), barium carbonate, barium sulfate, silicic acid fine powder, calcium silicate, (synthetic) aluminum silicate, talc, calcined kaolin, titanium oxide, zinc oxide, pyrophyllite, diatomaceous earth, fine particulate anhydrous silica, amorphous silica, activated clay, and surface-treated calcium carbonate or silica; and organic pigments such as styrene microballs, nylon powders, polyethylene powders, urea-formalin resin fillers, phenol resins, epoxy resins, styrene-methacrylic acid copolymer resins, polystyrene resins, raw starch particles, nylon, melamine resins, and benzoguanamine resins. The content of the pigment is preferably an amount that does not decrease color density; that is, at most 50 mass % of the total solids content of the thermosensitive recording layer.

The thermosensitive recording layer is typically formed on the undercoat layer by applying a coating liquid for a thermosensitive recording layer prepared by using water as a dispersion medium, dispersing a leuco dye, a coloring agent, and, if necessary, a sensitizer and a storage stability improving agent together or separately with one of various stirrers/wet pulverizers such as a ball mill, a co-ball mill, an attritor, or a vertical or horizontal sand mill together with water-soluble synthetic polymer compounds such as polyacrylamide, polyvinyl pyrrolidone, polyvinyl alcohol, methylcellulose, and styrene-maleic anhydride copolymer salts and other surfactants to form a dispersion, dispersing the solution so that the average particle size is at most 2 μm, and using the resulting dispersion to mix pigments, adhesives, auxiliary agents, and the like as necessary, and then drying the coating liquid. The coated amount of the thermosensitive recording layer is not particularly limited and is preferably from approximately 1 to 12 $g/m^2$, more preferably from 2 to 10 $g/m^2$, even more preferably from 2.5 to 8 $g/m^2$, and particularly preferably from 3 to 5.5 $g/m^2$ in terms of the coated amount after drying. Note that the thermosensitive recording layer may be formed by dividing the layer into two or more layers as necessary, and the composition and coated amount of each layer may be the same or different.

Aqueous adhesives such as water-soluble adhesives and water-dispersible adhesives, for example, may be used as the adhesive used in the coating liquid for the thermosensitive recording layer. Examples of water-soluble adhesives include modified polyvinyl alcohols such as polyvinyl alcohol, carboxy-modified polyvinyl alcohol, acetoacetyl-modified polyvinyl alcohol, diacetone-modified polyvinyl alcohol, and silicon-modified polyvinyl alcohol; starches and derivatives thereof; cellulose derivatives such as methoxy cellulose, carboxymethyl cellulose, hydroxyethyl cellulose, hydroxypropylmethyl cellulose, methyl cellulose, and ethyl cellulose; sodium polyacrylate, polyvinylpyrrolidone, polyamide, diisobutylene-maleic anhydride copolymer salts, styrene-acrylic acid copolymer salts, styrene-maleic anhydride copolymer salts, ethylene-maleic anhydride copolymer salts, acrylic acid amide-acrylic acid ester copolymers, acrylic acid amide-acrylic acid ester-methacrylic acid copolymers, polyacrylamide, sodium alginate, gelatin, casein and gum arabic. Examples of water-dispersible adhesives include polyvinyl acetate, polyurethane, styrene-butadiene copolymers, styrene-butadiene-acrylonitrile copolymers, acrylonitrile-butadiene copolymers, polyacrylic acids, polyacrylic acid esters, vinylchloride-vinylacetate copolymers, polybutyl methacrylate, ethylene-vinylacetate copolymers, silylated urethane, acrylic-silicone composites, acrylic-silicone-urethane composites, and latexes of water-insoluble polymers such as urea resins, melamine resins, amide resins, and polyurethane resins. These may be used alone or in a combination of two or more types. At least one type of these is preferably contained in an amount in the range of approximately 5 to 50 mass % and more preferably from approximately 10 to 40 mass % of the total solids content of the thermosensitive recording layer.

The coating liquid for the thermosensitive recording layer may contain auxiliary agents such as dispersants, water resistance-imparting agents, waxes, metal soaps, colored dyes, organic pigments or inorganic pigments (basic inorganic pigments), colored pigments, fluorescent dyes, oil repellent agents, antifoaming agents, and viscosity adjusters as necessary.

Examples of water resistance-imparting agents include aldehyde-based compounds such as glyoxal, polyamine-based compounds such as polyethylene imide, epoxy-based compounds, polyamide resins, melamine resins, dimethylolurea compounds, aziridine compounds, blocked isocyanate compounds, dihydrazide carboxylate compounds such as dihydrazide adipate, glyoxylic acid salts, inorganic compounds such as ammonium persulfate, ferric chloride, magnesium chloride, tetraboric acid soda, potassium tetraborate, and boric acid, boric acid, boric acid triesters, boron-based polymers, and dialdehyde starches. These may be used alone or in a combination of two or more types. These water resistance-imparting agents are preferably used in an amount in the range of 0.1 to 10 mass % of the total solids content of the thermosensitive recording layer.

Examples of waxes include paraffin wax, carnauba wax, microcrystalline wax, polyethylene wax, and higher fatty acid ester wax. Examples of metal soaps include higher fatty acid polyvalent metal salts; that is, zinc stearate, aluminum stearate, calcium stearate, and zinc oleate.

The basic inorganic pigment is preferably at least one member selected from the group consisting of magnesium compounds, aluminum compounds, calcium compounds, titanium compounds, magnesium silicate, magnesium phosphate, and talc. Of these, magnesium silicate, magnesium phosphate, and talc are preferably used from the perspective of the stability of the coating liquid or the coating suitability.

Examples of dispersants include sodium dioctylsulfosuccinate, sodium dodecylbenzenesulfonate, sodium lauryl alcohol sulfate esters, and fatty acid metal salts.

1-4. Protective Layer

In the thermosensitive recording material (1), a protective layer may also be provided on the thermosensitive recording layer as necessary. The protective layer preferably contains a pigment and an adhesive. Furthermore, the protective layer preferably contains a lubricant such as polyolefin wax or zinc stearate for the purpose of preventing the layer from sticking to the thermal head, and the layer may also contain a UV absorber. In addition, the added value of the product may also be increased by providing a glossy protective layer.

The adhesive contained in the protective layer is not particularly limited, and aqueous adhesives such as water-soluble adhesives and water-dispersible adhesives may be used. The adhesive can be selected appropriately from the adhesives that can be used in the thermosensitive recording layer. The effect of the present invention can be further enhanced by containing a polyvinyl alcohol having a degree of polymerization of 1,000 to 3,000 as a water-soluble adhesive in an amount of 15 to 50 mass % of the total solids content of the protective layer. Examples of polyvinyl alcohols having a degree of polymerization of 1,000 to 3,000 include modified polyvinyl alcohols such as completely or partially saponified polyvinyl alcohol, acetoacetyl-modified polyvinyl alcohol, diacetone-modified polyvinyl alcohol, carboxy-modified polyvinyl alcohol, and silicon-modified polyvinyl alcohol. Of these, acetoacetyl-modified polyvinyl alcohol and diacetone-modified polyvinyl alcohol are preferable in that the barrier properties of the protective layer surface can be enhanced and in that the storage stability in terms of chemical resistance or the like can be enhanced. Additional examples include cellulose-based resins such as hydroxyethyl cellulose, methyl cellulose, and carboxymethyl cellulose and alkali salts of gelatin, casein, and ethylene-acrylic acid copolymers. Examples of water-dispersible adhesives include latexes such as styrene-butadiene latex, acrylic latex, and urethane latex. Of these, acetoacetyl-modified polyvinyl alcohol and diacetone-modified polyvinyl alcohol are preferably used in that the barrier properties of the surface can be enhanced and in that the storage stability in terms of chemical resistance or the like can be enhanced.

In addition, acrylic-based resins are preferable in that it is easy to impart water resistance in addition to the chemical resistance of the recorded part. The acrylic-based resin used in the protective layer is not particularly limited, but at least one acrylic monomer such as acrylic acid, methyl acrylate, ethyl acrylate, butyl acrylate, isobutyl acrylate, cyclohexyl acrylate, 2-ethylhexyl acrylate, hydroxyethyl acrylate, aminoethyl acrylate, methacrylic acid, methyl methacrylate, ethyl methacrylate, butyl methacrylate, isobutyl methacrylate, cyclohexyl methacrylate, 2-cyclohexyl methacrylate, tert-butyl methacrylate, aminoethyl methacrylate, acrylamide, and acrylonitrile may be contained as a component constituting the resin.

The amount of the acrylic monomer component is preferably at least 10 mass % of the total solids content of the acrylic-based resin. In addition, other monomers such as ethylene, styrene, butadiene, isobutylene, and maleic anhydride may be copolymerized with the acrylic-based resin in addition to acrylic monomers.

The total content of the aqueous adhesive in the protective layer is preferably from approximately 10 to 80 mass % and more preferably from approximately 20 to 75 mass % of the total solids content of the protective layer. By setting the content to at least 10 mass %, it is possible to achieve excellent barrier properties and to prevent the generation of paper dust by increasing the surface strength. On the other hand, by setting the content to at most 80 mass %, it is possible to suppress sticking, which obstructs recording.

When a water-soluble adhesive and a water-dispersible adhesive are used in combination, from approximately 5 to 100 parts by mass of the water-dispersible adhesive is preferably used per 100 parts by mass of the water-soluble adhesive.

Examples of the pigment in the protective layer include inorganic pigments such as calcium carbonate, zinc oxide, aluminum oxide, titanium dioxide, amorphous silica, synthetic mica, aluminum hydroxide, barium sulfate, talc, kaolin, clay, and calcined kaolin; and organic pigments such as nylon resin fillers, urea-formalin resin fillers, and raw starch particles. Of these, kaolin and aluminum hydroxide are preferably used since decreases in barrier properties against chemicals such as plasticizers or oils are small and decreases in recording density are also small.

The content of the pigment in the protective layer is preferably from approximately 5 to 80 mass % and more preferably from approximately 10 to 70 mass % of the total solids content of the protective layer. By setting the content to at least 5 mass %, it is possible to improve the smoothness with the thermal head and to suppress sticking or head scum. On the other hand, by setting the content to at most 80 mass %, it is possible to enhance the barrier properties and to dramatically enhance the function of the layer as a protective layer.

The protective layer is typically formed on the thermosensitive recording layer by applying a coating liquid for a protective layer prepared by using water as a dispersion medium and mixing a pigment, an adhesive, and, if necessary, auxiliary agents or the like, and then drying the coating liquid. The coated amount of the coating liquid for the protective layer is not particularly limited and is preferably from approximately 0.3 to 15 g/m$^2$, more preferably from approximately 0.3 to 10 g/m$^2$, even more preferably from approximately 0.5 to 8 g/m$^2$, particularly preferably from approximately 1 to 8 g/m$^2$, and even more preferably from approximately 1 to 5 g/m$^2$ in terms of dry weight. Here, the protective layer may be formed by dividing the layer into two or more layers as necessary, and the composition and coated amount of each layer may be the same or different.

Examples of auxiliary agents used in the coating liquid for the protective layer include lubricants such as zinc stearate, calcium stearate, polyethylene wax, carnauba wax, paraffin wax, and ester wax; surfactants including sodium alkylbenzenesulfonate, sodium dioctylsulfosuccinate, sulfonic acid-modified polyvinyl alcohol, acetylene glycol-based surfactants such as sodium acetylene glycol polyacrylate-based compounds, fluorine-based surfactants, silicone-based surfactants, phosphoric acid ester-based surfactants, ether-based surfactants, and amphoteric surfactants such as betaine, aminocarboxylic acid salts, and imidazoline derivatives; water resistance-imparting agents (crosslinking agents) such as glyoxal, boric acid, dialdehyde starch, methylolurea, glyoxylic acid salts, epoxy-based compounds, and hydrazine-based compounds; hydrophobic polycarboxylic acid copolymers, UV absorbers, fluorescent dyes, coloring dyes, release agents, and antioxidants. The amounts of the auxiliary agents that are used can be set appropriately from wide ranges.

1-5. Other Layers

In the thermosensitive recording material (1), a thermosensitive recording material having an adhesive layer on the surface of the support on the opposite to the surface on which the thermosensitive recording layer is provided or on the surface on which the thermosensitive recording layer is provided can be suitably used. Examples of the adhesive used in the thermosensitive recording material (1) include substances containing a rubber-based substance comprising natural rubber, styrene-butadiene rubber, polyisobutylene rubber, isoprene rubber, or the like as a main component, substances containing a vinyl ether-based substance as a main component, substances containing as a main component an acrylic-based substance such as a copolymerized polymer having 2-ethylhexylacrylate as a main monomer, and substances containing a rubber-like siloxane and a resin-like siloxane as main components. These may be used as emulsions, solvents, or various non-solvent adhesives. Plasticizers or emulsifiers may also be contained as adhesive components.

When a release sheet is used, the adhesive may be applied directly to the support to form an adhesive layer. Alternatively, the adhesive layer may be provided by applying the adhesive to the release agent surface of the release sheet to form an adhesive layer, attaching the layer to the support on a side opposite to the thermosensitive recording layer side, and then transferring the adhesive layer. In either case, a release sheet is attached to the adhesive layer in order to prevent unnecessary adhesion when the thermosensitive recording material is not used, and the release sheet is preferably peeled off as needed when the thermosensitive recording material is used. On the other hand, in a non-separation-type in which a release sheet is not used, the thermosensitive recording layer and the adhesive layer are laminated so as to sandwich a release layer or the like therebetween, and since the effect of the adhesive component is achieved as the support and the adhesive layer come into contact in the rolled state, the effect of the present invention can be expressed thoroughly.

As a release sheet, it is preferable for a release base paper such as a high-density base paper such as glassine paper, clay coat paper, craft paper, or polylaminate paper produced by laminating woodfree paper or the like with polyethylene or the like to have a release surface to which a fluorine resin, a silicone resin, or the like is attached as a release agent in the range of approximately 0.05 to 3 g/m$^2$ in terms of dry weight. A roll coater, a knife coater, a bar coater, a slot die coater, or the like, for example, is used as the coating method of the adhesive, and the coated amount is adjusted within the range of approximately 5 to 50 g/m$^2$ in terms of dry weight.

In the thermosensitive recording material (1), as necessary, a back surface layer containing a pigment and an adhesive (binder) as the main components can be provided on a surface of the support on the side opposite to the surface on which the thermosensitive recording layer is provided. As a result, the storage stability can be further enhanced, and curling suitability and/or running properties for printers can be enhanced. In addition, various publicly known techniques in the field of thermosensitive recording material production can be applied as necessary. For example, a magnetic recording layer and/or a layer to be coated by printing as well as a thermal transfer recording layer and/or an ink jet recording layer can be provided on the back surface.

The thermosensitive recording material (1) may be a multicolor thermosensitive recording material to further add value to the product. In general, a multicolor thermosensitive recording material has a structure in which a high temperature color developing layer and a low temperature color developing layer, which develop colors that differ from each other, are laminated sequentially on a support, and utilizes the difference of heating temperatures or difference of thermal energy. These multicolor thermosensitive recording materials are roughly classified into two types, which are a decoloring type and a color additive type. Furthermore, there are methods that use microcapsules and methods for producing a multicolor thermosensitive recording material by using composite particles formed from an organic polymer and a leuco dye.

1-6. Thermosensitive Recording Material Formation Method

In the thermosensitive recording material (1), the method for forming the anchor layer (1), the undercoat layer, the thermosensitive recording layer, and the protective layer is not particularly limited. It is possible to employ a known coating method such as an air knife method (air knife coating), a blade method (for example, vali-bar blade coating, pure blade coating, rod blade coating, and the like), a gravure method, a roll coater method, a curtain method (curtain coating), a spray method, a dipping method, a bar method (bar coating), an extrusion method, a short dwell coating, and die coating. In the thermosensitive recording material (1), smoothing treatment may be performed with a super calender after each layer is completely formed or at any stage after a specific layer is completely formed. In addition, a coating layer or the like may also be provided on the back surface of the support for the purpose of curl control or the like.

The undercoat layer is preferably a layer that is formed by a blade coating method. As a result, a thermosensitive recording layer having a uniform thickness can be formed by allowing no unevenness on the support, which makes it possible to enhance recording sensitivity and to enhance the barrier properties of the protective layer provided as necessary. The blade coating method is not limited to a coating method that uses a blade exemplified by a bevel type or bent type blade but also includes a rod blade method, a Billblade method, and the like.

In addition, pure blade coating or rod blade coating is preferable as the coating method of the coating liquid for the undercoat layer from the perspective of enhancing the surface properties of the undercoat layer. In addition, the formation of the thermosensitive recording layer and the protective layer is preferably achieved by simultaneously applying multiple layers by means of curtain coating. As a result, it is possible to prevent mixing between layers and to enhance the barrier properties of the protective layer by forming a uniform coating layer. Moreover, it is possible to enhance the productivity and to further reduce the energy consumption at the time of production. Curtain coating is a method by which the coating liquid is channeled down and dropped freely to coat the substrate without direct contact. Any publicly known curtain coating method, such as slide curtain method, couple curtain method, and twin curtain method, can be employed, and the curtain coating method is not particularly limited. In addition, as described in Japanese Unexamined Patent Application Publication No. 2006-247611A, it is also possible to use a method with a multi-stage curtain coater to form a coating layer on an inclined surface by dispensing the coating liquid downward from curtain heads, and then transferring the curtain layer onto a web surface by forming a curtain of the coating liquid from a downward curtain guide part on the end part of the inclined surface. Here, simultaneous multilayer coating is a method of simultaneously coating upper and lower layers when coating two or more layers, and this includes a method of applying a lower layer and then applying upper layer without drying the lower layer.

In the thermosensitive recording material (1), a support in which the surface roughness of the support surface under a pressure of 20 kg/cm$^2$ measured with a microtopograph is at least 6 Lm is preferable in that the print quality-enhancing effect is observed more prominently. By providing the anchor layer (1) and the undercoat layer in the thermosensitive recording material (1), the coatability of the thermosensitive recording material improves, which makes it possible to enhance the recording color developability and the recording image quality even with a support having a rough surface with a surface roughness of at least 6 μm, more preferably at least 8 μm, and even more preferably at least 10 μm. On the other hand, sufficient recording performance can be achieved by setting the surface roughness to at most approximately 15 μm. The surface roughness is a value determined as the average value of three locations excluding the maximum and minimum values from five measurements taken with a "microtopograph" surface tester manufactured by Toyo Seiki Co., Ltd. under conditions with a contact time of 990 ms using a pressure contact with a diameter of 5.5 cm.

In the thermosensitive recording material (1), the Stockigt sizing degree of the support is preferably at most 15 seconds. The Stockigt sizing degree is more preferably at most 10 seconds. By providing the anchor layer (1) and the undercoat layer in the thermosensitive recording material (1), it is possible to suppress the penetration of the support by the coating liquid. This makes it possible to form a uniform thermosensitive recording layer and to enhance the recording color developability and the recording image quality, even with a support having a low sizing degree. The lower limit of the Stockigt sizing degree is not particularly limited but is preferably at least 1 second and more preferably at least 5 seconds from the perspective of improving the coating suitability of the coating liquid when forming the anchor layer (1). The Stockigt sizing degree is measured in accordance with JIS P 8122. The basis weight of the support is not particularly limited but is preferably from approximately 40 to 70 g/$^2$.

2. Thermosensitive Recording Material (2)

The thermosensitive recording material (2) relates to a thermosensitive recording material comprising an anchor layer (2) containing a sizing agent on a support (alternatively described as "undercoat layer (2)"), and a thermosensitive recording layer containing a leuco dye and a coloring agent on the anchor layer (2). More specifically, the material relates to a thermosensitive recording material in which the anchor layer (2) contains a specific amount of at least one member selected from the group consisting of ammonium salts of styrene-maleic anhydride copolymers and ammonium salts of styrene-acrylic acid copolymers as a sizing agent and further contains a pigment (also described as "thermosensitive recording material (2a)" hereafter); a thermosensitive recording material in which the anchor layer (2) contains at least one member selected from the group consisting of anionic styrene-acrylic copolymer resins and styrene-maleic acid copolymer resins as a sizing agent and further contains a pigment, and the thermosensitive recording layer contains N-[2-(3-phenylureido)phenyl]benzenesulfonamide as a coloring agent (also described as "thermosensitive recording material (2b)" hereafter); or a thermosensitive recording material in which the anchor layer (2) contains a sizing agent and a water resistance-imparting agent (also described as "thermosensitive recording material (2c)" hereafter).

In the thermosensitive recording material (2a), providing an anchor layer (2) such as that described above makes it possible to achieve excellent recording color developability and to prevent plasticizers, emulsifiers, or the like contained in the adhesive layer from penetrating the thermosensitive recording layer after being processed into a thermosensitive recording label. This suppresses decreases in recording performance after long-term storage. In addition, since the substance is an ammonium salt, there is no risk of the thermal head causing electric corrosion due to a sodium salt or the like. Furthermore, since the specific sizing agent in the thermosensitive recording material (2a) is a solvent-type agent, it is possible to form a relatively uniform layer so as to demonstrate excellent barrier properties.

In addition, in the thermosensitive recording material (2c), providing an anchor layer (2) containing at least a sizing agent and a water resistance-imparting agent on the support makes it possible to achieve excellent recording color developability and recording image quality. In addition, it is possible to prevent plasticizers, emulsifiers, or the like contained in the adhesive layer from penetrating the thermosensitive recording layer after being processed into a thermosensitive recording label, which yields excellent recording performance after long-term storage.

2-1. Support

The support in the thermosensitive recording material (2) is not particularly limited, and the supports listed as examples in section "1-1. Support" of "1. Thermosensitive recording material (1)" can be used. The thickness of the support is not particularly limited but is ordinarily from approximately 20 to 200 μm.

A paper support made of neutral paper or acidic paper obtained by making a pulp slurry containing pulp fibers, a filler, and a sizing agent into paper is more preferably used as the support in the thermosensitive recording material (2b). Typically, in the case of acidic paper, the color-developing substance constituting the thermosensitive recording material causes a reaction with acidic ions on the surface of the paper, which leads to a problem in that background fogging tends to occur during a long-term storage period. On the other hand, there are problems in that while the thermosensitive recording material is being stored—for example, when stored over the course of one year—the color developability is diminished prior to recording, whereas printing is blurred and unclear or, in some cases, almost completely invisible due to discoloration after printing. Conventionally, components contained in a thermosensitive recording layer have been differentiated in use by the type of the paper support. However, the thermosensitive recording material (2b) exhibits an excellent effect with regard to plasticizer resistance after blank paper storage in the case of either neutral paper or acidic paper, which makes it possible to achieve a thermosensitive recording material having a potentially high recording density and excellent blank-paper preservability without having heat resistance in the substrate. The reason for this is not clear, but it is presumed to be due to the fact that N-[2-(3-phenylureido)phenyl]benzenesulfonamide does not cause morphological changes, regardless of whether the paper is neutral paper or acidic paper, although, when an ordinary coloring agent forms a salt with an alkali filler contained in the neutral paper while the thermosensitive recording material is being stored, the performance of the coloring agent decreases.

The type and production method of the neutral paper are not particularly limited, but it can be obtained by making paper from a pulp slurry containing pulp fiber and typically a filler. Specific examples of fillers that can be used are those listed as examples in section "1-1. Support" of "1. Thermosensitive recording material (1)".

The pH of the neutral paper is preferably such that the hot water extraction pH (based on JIS P 8133) is in a range of 6.5 to 10 and more preferably in a range of 7.5 to 10. By setting the pH of the neutral paper to at least 6.5, it is possible to effectively suppress background fogging at the time of blank paper storage. On the other hand, by setting the pH to at most 10, it is possible to suppress the aggregation of the pulp slurry itself. In addition, the paper making performance can also be enhanced by adjusting the pH using a sulfuric acid band as necessary within a range in which the pH does not fall below 6.5.

The hot water extraction pH (based on JIS P 8133) when acidic paper is used is in the range of approximately 2 to 6.

The type, production method, and the like of the pulp fibers used in the thermosensitive recording material (2) are not particularly limited, but those listed as examples in section "1-1. Support" of "1. Thermosensitive recording material (1)" can be used.

Specific examples of internal auxiliary agents added to the pulp slurry and the paper making machine include those listed as examples in section "1-1. Support" of "1. Thermosensitive recording material (1)".

2-2. Anchor Layer (2)

In the thermosensitive recording material (2), an anchor layer (2) containing a pigment and a sizing agent is provided on the support. Alternatively, an anchor layer (2) containing a sizing agent and a water resistance-imparting agent is provided. The sizing agent has strong water resistance of the film itself, and once it is dried, it will never dissolve again even when in contact with water. In the thermosensitive recording material (2c), providing an anchor layer (2) between the support and the thermosensitive recording layer is thought to enhance the barrier properties by uniformly dispersing the sizing agent and the water resistance-imparting agent. As a result, components which inhibit color-developing reactions do not pass through the support, and the penetration of the anchor layer (2) by the coating liquid for the thermosensitive recording layer is suppressed. In addition, a uniform coating layer is formed so as to yield excellent recording performance. The sizing agent in the thermosensitive recording material (2b) is anionic and is at least one member selected from the group consisting of styrene-acrylic copolymer resins and styrene-maleic acid copolymer resins. The sizing agent is preferably an anionic styrene-maleic acid copolymer resin. As a result, even when processed into an adhesive label, it is possible to suppress color defects after storage over time due to the effects of the adhesive component, which makes it possible to develop colors with the initial recording density prior to storage. In addition, the thermosensitive recording material (2b) is excellent with regard to background fogging and blank-paper preservability, even when neutral paper or acidic paper is used as a support. The reason for this is not clear, but it is thought to be due to the fact that the barrier properties of the anchor layer (2) are enhanced, which suppresses contact between the sensitizer or coloring agent in the thermosensitive recording layer and alkaline fillers or acidic ions in the support or surfactants or the like contained in the adhesive. Thus, it is possible to thoroughly express the effect of the specific coloring agent in the present invention.

In addition, the sizing agent in the thermosensitive recording material (2c) is not particularly limited, and those listed as examples in section "1-2. Anchor layer (1)" of "1. Thermosensitive recording material (1)" can be used.

The content of the sizing agent in the anchor layer (2) of the thermosensitive recording material (2c) is, in terms of solids content, preferably from approximately 1 to 9 mass %, more preferably from approximately 2 to 8 mass %, and even more preferably from approximately 2.5 to 5 mass % of the total solids content of the anchor layer (2). By setting the content to at least 1 mass %, it is possible to sufficiently withstand long-term storage after being processed into a thermosensitive recording label, and it is possible to increase the recording color developability and to enhance the recording image quality. On the other hand, by setting the content to at most 9 mass %, it is possible to increase the recording color developability and to enhance the sensitivity of the thermosensitive recording layer.

A water resistance-imparting agent is contained in the anchor layer (2) of the thermosensitive recording material (2c). Examples of water resistance-imparting agents include aziridine compounds, blocked isocyanate compounds, dihydrazide carboxylate-based compounds such as dihydrazide adipate, glyoxal, formalin, glycin, glycidyl esters, glycidyl ether, dimethylolurea, melamine resins, polyamide resins, polyamide polyamine-epichlorohydrin resins, ketone-aldehyde resins, ammonium persulfate, ferric chloride, magnesium chloride, zirconium ammonium carbonate salts, borax, boric acid, tetraboric acid soda, boric acid triesters, boron-based polymers, potassium tetraborate, zirconium ammonium carbonate, epoxy compounds, hydrazide compounds, oxazoline group-containing compounds, and glyoxylic acid salts such as sodium glyoxylate, calcium di(glyoxylate), and ammonium glyoxylate. These may be used alone or in a combination of two or more types. These water resistance-imparting agents are preferably used in an amount in the range of 0.1 to 10 mass % and more preferably from approximately 1 to 5 mass % of the total solids content of the anchor layer (2).

The water resistance-imparting agent contained in the anchor layer (2) is preferably at least one member selected from the group consisting of aziridine compounds, dihydrazide carboxylate compounds, glyoxal, glycin, glycidyl esters, glycidyl ether, dimethylolurea, melamine resins, polyamide resins, polyamide polyamine-epichlorohydrin resins, ketone-aldehyde resins, zirconium ammonium carbonate salts, borax, boric acid, boron-based polymers, oxazoline group-containing compounds, and glyoxylic acid salts from the perspective of enhancing the barrier properties and enhancing the color developability by suppressing the non-uniform penetration of the anchor layer by the coating liquid for the thermosensitive recording layer. These water resistance-imparting agents have the effect of increasing the adhesion between the thermosensitive recording layer and the protective layer formed on the anchor layer and thereby enhancing the surface strength. The content of the water resistance-imparting agent is not particularly limited but is preferably such that the sizing agent is contained in an amount of approximately 0.5 to 5 parts by mass and more preferably from approximately 1 to 4 parts by mass, in terms of solids content, per 1 part by mass of the water resistance-imparting agent.

The anchor layer (2) is typically formed on the support by applying a coating liquid for the anchor layer (2) prepared by using water as a dispersion medium and mixing a sizing agent, a water resistance-imparting agent, and, if necessary, a pigment, other aqueous resins, auxiliary agents, and the like, and drying the coating liquid. The coated amount of the anchor layer (2) is not particularly limited but is preferably from approximately 3 to 20 g/m$^2$ and more preferably from approximately 5 to 15 g/m$^2$ in terms of dry weight.

The sizing agents used in the thermosensitive recording materials (2a) and (2b) are preferably in the form of ammonium salts. By using an ammonium salt, there is no risk of the thermal head causing electric corrosion due to a sodium salt or the like, for example. Furthermore, the form is preferably a solvent-type agent. When an emulsion-type agent is used, the agent bleeds upward in the drying process of the anchor layer (2), and the pigment sinks into the support side, which makes it difficult to form a uniform layer and leads to a risk of losing the barrier properties with respect to the adhesive layer. However, using a solvent-type agent makes it possible to exhibit barrier properties by forming a uniform layer.

The content of the at least one member selected from the group consisting of ammonium salts of styrene-maleic anhydride copolymers and ammonium salts of styrene-acrylic acid copolymers in the thermosensitive recording material (2a) is in the range of at least 0.5 parts by mass and less than 5 parts by mass per 100 parts by mass of the pigment contained in the anchor layer (2). The content is more preferably from 1 to 4 parts by mass. When the content is less than 0.5 parts by mass, the recording color developability and the recording image quality are diminished after the material is processed into a thermosensitive recording label. When the content is at least 5 parts by mass, the recording color developability decreases, and there is a risk that the sensitivity of the thermosensitive recording layer may be diminished.

In addition, the content of the sizing agent in the anchor layer (2) of the thermosensitive recording material (2b) is not particularly limited but is preferably from 0.1 to 1.0 parts by mass, more preferably from 0.1 to 0.7 parts by mass, and even more preferably from 0.2 to 0.7 parts by mass per 1 part by mass of N-[2-(3-phenylureido)phenyl]benzenesulfonamide.

In addition, the content of the sizing agent in the anchor layer (2) of the thermosensitive recording material (2b) is not particularly limited but is preferably from 1 to 20 mass %, more preferably from 2 to 10 mass %, and even more preferably from 4 to 10 mass % of the total solids content of the anchor layer (2). By setting the content to at least 1 mass %, it is possible to achieve sufficient barrier properties, and by setting the content to at most 20 mass %, it is possible to achieve sufficient recording sensitivity.

The sizing agent contained in the anchor layer (2) of the thermosensitive recording material (2b) is at least one member selected from the group consisting of anionic styrene-acrylic copolymer resins and styrene-maleic acid copolymer resins, but various known materials may be used in combination as necessary within a range that does not cause problems. Specific examples that can be used include the sizing agents listed in section "1-2. Anchor layer and undercoat layer" of "1. Thermosensitive recording material (1)". These sizing agents may be used alone or in a combination of two or more types.

Other adhesives may also be used in combination in the anchor layer (2) of the thermosensitive recording material (2) as long as the effect of the present invention is not diminished. The adhesives listed in section "1-2. Anchor layer and undercoat layer" of "1. Thermosensitive recording material (1)" may be used as these other adhesives. The total content of the adhesive is not particularly limited but is preferably from approximately 5 to 30 mass % and or preferably from approximately 10 to 20 mass % of the total solids content of the anchor layer (2).

In addition, the anchor layer (2) of the thermosensitive recording material (2) may also contain an aqueous resin as long as the effect of the present invention is not diminished. The aqueous resins listed in section "1-2. Anchor layer and undercoat layer" of "1. Thermosensitive recording material (1)" can be used as aqueous resins. Two types of these aqueous resins may be used in combination, and the total content thereof is not particularly limited but is preferably from approximately 5 to 30 mass %, more preferably from approximately 8 to 20 mass %, and even more preferably from approximately 10 to 20 mass % of the total solids content of the anchor layer (2).

The pigment contained in the anchor layer (2) is not particularly limited but is preferably an oil-absorptive pigment and/or plastic hollow particles (organic hollow particles) and/or thermal expansion particles having an oil absorption of at least 70 mL/100 g and particularly preferably from approximately 80 to 150 mL/100 g. The oil absorption is a value determined in accordance with the method of JIS K 5101. The oil-absorptive pigments listed in section "1-2. Anchor layer (1) and undercoat layer" of "1. Thermosensitive recording material (1)" can be used as oil-absorptive pigments. The average particle size of the primary particles of these oil-absorptive pigments is preferably from approximately 0.01 to 5 μm and more preferably from approximately 0.02 to 3 μm. The content of the oil-absorptive pigment is not particularly limited but is preferably from approximately 2 to 95 mass %, more preferably from approximately 5 to 90 mass %, and even more preferably from approximately 30 to 80 mass % of the total solids content of the anchor layer (2).

The thermosensitive recording material (2) preferably has an anchor layer (2) containing plastic hollow particles between the support and the thermosensitive recording layer.

As a result, the recording sensitivity can be further enhanced. In addition, when plastic hollow particles accumulate on the support to form a uniform anchor layer (2), it is possible to make the thickness of the coating layer provided on the anchor layer (2) uniform, which makes it possible to enhance the barrier properties.

The conventionally known particles listed in section "1-2. Anchor layer and undercoat layer" of "1. Thermosensitive recording material (1)" can be used as plastic hollow particles. The average particle size of the plastic hollow particles is preferably from approximately 0.5 to 10 μm and more preferably from approximately 1 to 3 μm. The content of the plastic hollow particles is not particularly limited but is preferably from approximately 2 to 90 mass %, more preferably from approximately 5 to 70 mass %, and even more preferably from approximately 10 to 50 mass % of the total solids content of the anchor layer (2). By setting the average particle size to at most 10 μm, good coatability can be achieved since such a particle size does not cause troubles such as streaks and scratches when the coating liquid for the anchor layer (2) is coated by a blade coating method.

The content of the plastic hollow particles can be set from a wide range but is typically preferably from approximately 2 to 90 mass % of the total solids content of the anchor layer (2). From the perspectives of enhancing barrier properties and improving effect of color developability, the lower limit thereof is more preferably at least 5 mass %, and even more preferably at least 10 mass %. Meanwhile, from the perspective of suppressing adhesion of dirt to a thermal head, the upper limit thereof is more preferably at most 80 mass %, even more preferably 70 at most mass %, particularly preferably at most 60 mass %, and most preferably at most 50 mass %.

When an oil-absorptive pigment and plastic hollow particles are used in combination, the oil-absorptive pigment and the plastic hollow particles are used within the ranges of the contents described above. The total content of the oil-absorptive pigment and the plastic hollow particles is preferably from approximately 5 to 90 mass %, more preferably from approximately 5 to 93 mass %, even more preferably from approximately 10 to 85 mass %, and particularly preferably from approximately 10 to 80 mass % of the total solids content of the anchor layer (2).

In the present invention, the mass ratio of the oil-absorptive pigment to the plastic hollow particles in the anchor layer is preferably in the range of 100/0 to 40/60, more preferably in the range of 90/10 to 60/40, and even more preferably in the range of 85/15 to 70/30. By setting the mass ratio of the oil-absorptive pigment to at most 100, it is possible to increase the cushioning of the anchor layer and to enhance the recording color developability and the recording image quality. On the other hand, by setting the mass ratio to at least 40, it is possible to sufficiently express the oil-absorptive capacity of the anchor layer and to enhance the recording image quality by reducing image defects due to head residues or the like. In addition, when the mass ratio is within this range, it is possible to further enhance the barrier properties and to enable the material to sufficiently withstand long-term storage after being processed into a thermosensitive recording label.

The anchor layer (2) can be formed by applying and drying a coating liquid for the anchor layer (2) prepared using water as a medium, for example and containing a pigment, a specific sizing agent, and, as necessary, various additives on a paper support. The coated amount of the anchor layer (2) is not particularly limited but is preferably adjusted within the range of 2 to 30 g/m$^2$, more preferably from 4 to 15 g/m$^2$, and even more preferably from approximately 5 to 12 g/m$^2$ in terms of dry weight.

2-3. Thermosensitive Recording Layer

The leuco dye used in the thermosensitive recording layer of the thermosensitive recording material (2) is not particularly limited as long as it is a dye used in typical thermosensitive recording paper. Specific examples of leuco dyes that can be used include the leuco dyes listed in section "1-3. Thermosensitive recording layer" of "1. Thermosensitive recording material (1)". These leuco dyes can be used alone or in a combination of two or more types and are selected appropriately in accordance with the application and the desired properties of the thermosensitive recording material.

In addition, the content of the leuco dye is set appropriately in accordance with the content of the leuco dye described in section "1-3. Thermosensitive recording layer" of "1. Thermosensitive recording material (1)", but in the case of the thermosensitive recording material (2a), the content is preferably from approximately 3 to 50 mass % and particularly preferably from approximately 5 to 40 mass % of the total solids content of the thermosensitive recording layer.

The content of the leuco dye in the case of the thermosensitive recording material (2b) is from approximately 5 to 25 mass % and preferably from approximately 7 to 20 mass % of the total solids content of the thermosensitive recording layer. By setting the content to at least 5 mass %, the color developability can be enhanced to improve the printing density. By setting the content to at most 25 mass %, the heat resistance can be enhanced.

The content of the leuco dye in the case of the thermosensitive recording material (2c) is not particularly limited but is preferably from approximately 3 to 30 mass % of the total solids content of the thermosensitive recording layer.

The coloring agents listed in section "1-3. Thermosensitive recording layer" of "1. Thermosensitive recording material (1)" can be used as the coloring agent in the thermosensitive recording material (2a).

In addition, the material may contain N-[2-(3-phenylureido)phenyl]benzenesulfonamide as the coloring agent in the thermosensitive recording material (2b). As a result, it is possible to obtain a thermosensitive recording material having high recording density, excellent image stability, good background fogging when stored at high temperatures, and no color defects after storage over time due to the effects of the adhesive component.

The volume-average particle size of the N-[2-(3-phenylureido)phenyl]benzenesulfonamide in the thermosensitive recording material (2b) is preferably at most 2 μm. The combination of coloring agents in the thermosensitive recording material (2b) yields excellent thermal background fogging resistance in high-temperature environments, which makes it possible to reduce the particle size and yields an excellent effect of increasing the recording density. The volume-average particle size is preferably at least 0.1 μm and more preferably at least 0.2 μm from the perspective of reduced production efficiency and reduced background fogging due to an increasingly long dispersion time. On the other hand, the volume-average particle size is preferably at most 1.0 μm and even more preferably at most 0.6 μm from the perspective of enhancing the recording density. The coloring agent may be contained in the thermosensitive recording layer as a dispersion having a specific volume-average particle size.

The thermosensitive recording layer in the thermosensitive recording material (2b) preferably further contains a urea urethane compound represented by general formula (1)

above (also called a "specific urea urethane compound" hereafter) as a coloring agent. As a result, the thermosensitive recording material exhibits excellent image stability, good background fogging when stored at high temperatures, and an excellent effect on color defects after storage over time due to the effects of the adhesive component. Specific examples of specific urea urethane compounds that can be used include the listed in section "1-3. Thermosensitive recording layer" of "1. Thermosensitive recording material (1)". These specific urea urethane compounds may be used alone or in a combination of two or more types.

In addition, in the thermosensitive recording material (2b), the urea urethane compound represented by general formula (1) above is preferably heat-treated in the same liquid as a basic inorganic pigment. For example, when the thermosensitive recording layer is formed using a coating liquid for a thermosensitive recording layer containing 4,4'-bis[(4-methyl-3-phenoxycarbonylaminophenyl)ureido]diphenylsulfone, the 4,4'-bis[(4-methyl-3-phenoxycarbonylaminophenyl)ureido]diphenylsulfone can be blended into the coating liquid for the thermosensitive recording layer as a dispersion that has been heat-treated in advance within a temperature range of 50 to 90° C. and preferably from 60 to 80° C. in the same liquid as a basic inorganic pigment. As a result, it is possible to suppress the occurrence of excessive color development (background fogging) in the thermosensitive recording material after the thermosensitive recording layer is formed by applying and drying the coating liquid for the thermosensitive recording layer. The treatment time is adjusted appropriately in accordance with the heating temperature, but heat treatment is typically preferably performed for 2 to 24 hours. The dispersion prior to heat treatment may be obtained by dispersing 4,4'-bis[(4-methyl-3-phenoxycarbonylaminophenyl)ureido]diphenylsulfone to a prescribed particle size and then mixing a basic inorganic pigment, or the dispersion may be obtained by mixing the respective components and then dispersing the mixture into a prescribed particle size.

The pigments listed in section "1-3. Thermosensitive recording layer" of "1. Thermosensitive recording material (1)" can be used as basic inorganic pigments. Of these, magnesium silicate, magnesium phosphate, and talc are preferably used from the perspective of the stability of the coating liquid or the coating suitability.

The amount of the basic inorganic pigment that is used is not particularly limited but is from approximately 0.5 to 20 parts by mass and preferably from approximately 1 to 10 parts by mass per 100 parts by mass of the specific urea urethane compound.

The content of the specific urea urethane compound in the thermosensitive recording layer is preferably from approximately 0.03 to 2.5 parts by mass and more preferably from approximately 0.05 to 2.0 parts by mass per 1 part by mass of the N-[2-(3-phenylureido)phenyl]benzenesulfonamide. By setting the content to at least 0.03 parts by mass, sufficient plasticizer resistance can be achieved in the recorded part. On the other hand, by setting the content to at most 2.5 parts by mass, it is possible to enhance background fogging in high-temperature environments.

The content of the specific urea urethane compound in the thermosensitive recording layer is preferably from 0.1 to 3.0 parts by mass, more preferably from 0.2 to 2.5 parts by mass, and even more preferably from 0.5 to 2.0 parts by mass per 1 part by mass of the leuco dye. The specific urea-urethane compound can be used in an amount adjusted within the aforementioned content range with respect to N-[2-(3-phenylureido)phenyl]benzenesulfonamide.

The content of N-[2-(3-phenylureido)phenyl]benzenesulfonamide in the thermosensitive recording layer is preferably from 0.5 to 5 parts by mass, more preferably from 0.8 to 4 parts by mass, even more preferably from 1 to 4 parts by mass, and particularly preferably from 1.2 to 3.5 parts by mass per 1 part by mass of the leuco dye.

Although the coloring agent in the thermosensitive recording material (2b) is N-[2-(3-phenylureido)phenyl]benzenesulfonamide, various known materials can also be used in combination as necessary within a range that does not cause problems. Specific examples of coloring agents that can be used include the coloring agents listed in section "1-3. Thermosensitive recording layer" of "1. Thermosensitive recording material (1)".

The content of the coloring agent in the thermosensitive recording material (2a) may be selected appropriately in accordance with the leuco dye that is used but is typically preferably from 1 to 10 parts by mass and more preferably from 1.5 to 5 parts by mass per 1 part by mass of the leuco dye.

In addition, the content of the coloring agent in the thermosensitive recording material (2c) is not particularly limited and may be adjusted in accordance with the leuco dye that is used, but the content is typically preferably from approximately 0.5 to 10 parts by mass, more preferably from approximately 0.8 to 10 parts by mass, even more preferably from approximately 1 to 10 parts by mass, and particularly preferably from approximately 1.5 to 5 parts by mass per 1 part by mass of the leuco dye.

Examples of these leuco dyes and coloring agents are listed in section "1-3. Thermosensitive recording layer" of "1. Thermosensitive recording material (1)", and these leuco dyes and coloring agents can be used in the preparation of the coating liquid for the thermosensitive recording layer.

Examples of other materials constituting the thermosensitive recording layer include dispersants, water resistance-imparting agents, adhesives, sensitizers, colored dyes, inorganic or organic pigments, fluorescent dyes, oil repellent agents, waxes, metal soaps, and, as necessary, UV absorbers, storage stability improving agents, fluorescent dyes, coloring dyes, antifoaming agents, viscosity adjusters, and various other auxiliary agents. Specific examples of adhesives that can be used include the adhesives listed in section "1-3. Thermosensitive recording layer" of "1. Thermosensitive recording material (1)".

The thermosensitive recording layer may also contain a storage stability improving agent. As a result, the storage stability of the recorded part can be enhanced. Specific examples of storage stability improving agents that can be used include the storage stability improving agents listed in section "1-3. Thermosensitive recording layer" of "1. Thermosensitive recording material (1)".

The content of the storage stability improving agent may be an effective amount for improving storage stability, but the content is typically preferably from approximately 1 to 30 mass % and more preferably from approximately 5 to 20 mass % of the total solids content of the thermosensitive recording layer.

The thermosensitive recording layer may also contain a sensitizer. As a result, the recording sensitivity can be enhanced. Specific examples of sensitizers that can be used include the sensitizers listed in section "1-3. Thermosensitive recording layer" of "1. Thermosensitive recording material (1)".

The content of the sensitizer may be an effective amount for sensitization, but the content is ordinarily preferably from approximately 2 to 40 mass % and more preferably from approximately 5 to 25 mass % of the total solids content of the thermosensitive recording layer. In addition, the content of the sensitizer is not particularly limited but is typically preferably adjusted within the range of at most approximately 4 parts by mass per 1 part by mass of the coloring agent.

Examples of water resistance-imparting agents that can be used include the water resistance-imparting agents listed in section "1-3. Thermosensitive recording layer" of "1. Thermosensitive recording material (1)". The water resistance-imparting agent is preferably used within a range of 0.1 to 10 mass % of the total solids content of the thermosensitive recording layer.

The inorganic pigments, waxes, and auxiliary agents listed in section "1-3. Thermosensitive recording layer" of "1. Thermosensitive recording material (1)" can be used as inorganic pigments, waxes, and auxiliary agents.

The thermosensitive recording layer can typically be formed by applying and drying a coating liquid for the thermosensitive recording layer prepared by using water as a medium and mixing a leuco dye, a coloring agent, and, as necessary, a storage stability improving agent, a dispersant such as a sensitizer, and various materials on the anchor layer (2). The coated amount of the thermosensitive recording layer is not particularly limited but is preferably from 2 to 10 g/m$^2$, more preferably from 2.5 to 8 g/m$^2$, and even more preferably from 3 to 5.5 g/m$^2$.

The thermosensitive recording layer is formed, for example, by coating a coating liquid for the thermosensitive recording layer on a support in a manner that the coated amount is preferably from approximately 2 to 12 g/m$^2$ and more preferably from approximately 3 to 10 g/m$^2$ in terms of dry weight, followed by drying. The coating liquid is prepared, for example, by using water as a dispersing medium, and by mixing and stirring a dispersion, in which the leuco dye, the particular coloring agent, and as necessary the sensitizer and the storage stability improving agent and the like are finely dispersed by subjecting these together or separately to treatment using a stirrer and/or pulverizer such as a ball mill, attritor, or sand mill, to make the average particle size thereof to be 2 μm or less, and as necessary the pigment, the adhesive (binder), and the auxiliary agent.

2-4. Protective Layer

In the thermosensitive recording material (2), at least one protective layer may be provided on the thermosensitive recording layer as necessary. A protective layer conventionally used in known thermosensitive recording materials can be used as the protective layer. The protective layer primarily comprises a pigment and an adhesive and can be formed by applying and drying a coating liquid for the protective layer containing these components. In particular, a lubricant such as polyolefin wax or zinc stearate is preferably added to the protective layer for the purpose of preventing the layer from sticking to the thermal head, and the layer may also contain a UV absorber. In addition, the added value of the product may also be increased by providing a glossy protective layer.

Examples of adhesives that can be used in the protective layer include the adhesives and the like included in section "1-4. Protective layer" of "1. Thermosensitive recording material (1)". Of these, modified polyvinyl alcohols such as acetoacetyl-modified polyvinyl alcohol, silicon-modified polyvinyl alcohol, diacetone-modified polyvinyl alcohol, and carboxy-modified polyvinyl alcohol and acrylic-based resins are particularly preferable in that it is easy to impart water resistance in addition to the chemical resistance of the recorded part. In particular, acetoacetyl-modified polyvinyl alcohol and diacetone-modified polyvinyl alcohol are preferable.

In addition, examples of acrylic-based resins that can be used in the protective layer include the acrylic-based resins listed in section "1-4. Protective layer" of "1. Thermosensitive recording material (1)".

The amount of the acrylic monomer component is preferably at least 10 mass % of the total solids content of the acrylic-based resin. In addition, other monomers such as ethylene, styrene, butadiene, isobutylene, and maleic anhydride may be copolymerized with the acrylic-based resin in addition to acrylic monomers.

The content of the adhesive in the protective layer is not particularly limited but is, for example, preferably from approximately 10 to 80 mass % and more preferably from approximately 20 to 75 mass % of the total solids content of the protective layer. By setting the content to at least 10 mass %, it is possible to achieve excellent barrier properties and to prevent the generation of paper dust by increasing the surface strength. On the other hand, by setting the content to at most 80 mass %, it is possible to suppress sticking, which obstructs recording. Furthermore, the pigments, auxiliary agents, and the like added to the thermosensitive recording layer described above can be used in the protective layer.

In addition, the total content of the water-soluble polymer and/or the synthetic resin emulsion is preferably from approximately 10 to 80 mass % and particularly preferably from approximately 20 to 75 mass % of the total solids content of the protective layer. By setting the content to at least 10 mass %, the barrier properties are enhanced, which makes it possible to increase the surface strength and reduce paper dust. On the other hand, by setting the content to at most 80 mass %, the sticking resistance can be enhanced.

When a water-soluble polymer and a synthetic resin emulsion are used in combination, the usage ratio thereof is preferably such that the content of the synthetic resin emulsion is from approximately 5 to 100 parts by mass per 100 parts by mass of the water-soluble polymer.

The pigments listed in section "1-4. Protective layer" of "1. Thermosensitive recording material (1)" can be used as pigments. Of these, kaolin and aluminum hydroxide are preferably used since decreases in barrier properties against chemicals such as plasticizers or oils are small and decreases in recording density are also small.

The content of the pigment is preferably from approximately 5 to 80 mass % and more preferably from approximately 10 to 70 mass % of the total solids content of the protective layer. By setting the content to at least 5 mass %, it is possible to improve the smoothness with the thermal head and to enhance the sticking resistance and head residue resistance. On the other hand, by setting the content to at most 80 mass %, it is possible to enhance the barrier properties and to dramatically enhance the function of the layer as a protective layer.

The auxiliary agents listed in section "1-4. Protective layer" of "1. Thermosensitive recording material (1)" can be used as auxiliary agents. The amounts of the auxiliary agents that are used can be set appropriately from wide ranges.

The protective layer can typically be formed by applying and drying a coating liquid for the protective layer prepared by using water as a medium and containing a pigment and an adhesive on the thermosensitive recording layer. The coated amount of the coating liquid for the protective layer is not particularly limited, and the desired quality can be achieved when the content is from approximately 0.3 to 10 g/m$^2$ and particularly from approximately 0.5 to 8 g/m$^2$ in terms of dry weight. The protective layer may be divided into two or more layers as necessary, and the composition and coated amount of each layer may also be varied.

2-5. Other Layers

In the thermosensitive recording material (2), an adhesive layer is preferably provided on the surface of the support on the side opposite to the surface on which the thermosensitive recording layer is provided or on the surface on which the thermosensitive recording layer is provided. The excellent effect of the present invention can be exhibited thoroughly by using a thermosensitive recording material processed into an adhesive label provided with an adhesive layer. The adhesives listed as examples in "1-5. Other layers" of "1. Thermosensitive recording material (1)" can be used as the adhesives used in the thermosensitive recording material (2).

When a release sheet is used, the adhesive may be applied directly to the support to form an adhesive layer, or the adhesive layer may be provided by applying the adhesive to the release agent surface of the release sheet to form an adhesive layer, attaching the layer to the support on the side opposite to the thermosensitive recording layer, and then transferring the adhesive layer. In either case, a release sheet is attached to the adhesive layer in order to prevent unnecessary adhesion when the thermosensitive recording material is not used, and the release sheet is preferably peeled off as needed when the thermosensitive recording material is used. On the other hand, in a non-separation-type in which a release sheet is not used, the thermosensitive recording layer and the adhesive layer are laminated so as to sandwich a release layer or the like therebetween, and since the effect of the adhesive component is achieved as the support and the adhesive layer come into contact in the rolled state, the effect of the present invention can be expressed thoroughly.

Specific examples of release sheets that can be used are those listed as examples in section "1-5. Other layers" of "1. Thermosensitive recording material (1)". A roll coater, a knife coater, a bar coater, a slot die coater, or the like, for example, is used as the coating method of the adhesive, and the coated amount is adjusted within the range of approximately 5 to 50 g/m$^2$ in terms of dry weight.

In the thermosensitive recording material (2), as necessary, a back surface layer containing a pigment and an adhesive as the main components can be provided on a surface of the support on the side opposite to the surface on which the thermosensitive recording layer is provided. As a result, the storage stability can be further enhanced, and the curling suitability and/or running properties for printers can be enhanced. In addition, various publicly known techniques in the field of thermosensitive recording material production can be applied as necessary. For example, a magnetic recording layer and/or a layer to be coated by printing as well as a thermal transfer recording layer and/or an ink jet recording layer can be provided on the back surface.

2-6. Thermosensitive Recording Material Formation Method

The method for applying each coating liquid described above is not particularly limited, and the coating methods described as examples in section "1-6. Thermosensitive recording material formation method" of "1. Thermosensitive recording material (1)" can be used.

The thermosensitive recording material (2) may be a multicolor thermosensitive recording material to further add value to the product. As a specific production method of a multicolor thermosensitive recording material, the material can be produced by the methods given as examples in section "1-6. Thermosensitive recording material formation method" of "1. Thermosensitive recording material (1)".

EXAMPLES

Working examples will be described in detail hereinafter, but the present invention is not limited to these working examples. Note that "parts" and "%" in the examples refer to "parts by mass" and "mass %" unless specified otherwise.

The average particle sizes of the dispersions used in the working examples and comparative examples were determined by measuring the median diameters with an SALD 2200 laser diffraction-type particle size distribution measuring apparatus (manufactured by the Shimadzu Corporation).

Working Example 1-1

Preparation of Coating Liquid for Anchor Layer (1)

A coating liquid for an anchor layer (1) was obtained by mixing and stirring a composition comprising 130 parts of a 50% aqueous dispersion of calcined kaolin (trade name: Ansilex-93, manufactured by BASF), 48 parts of a plastic hollow particle dispersion (trade name: Ropaque SN-1055, hollow ratio: 55%, average particle size: 1.0 μm, manufactured by Dow Corning Materials, solids content concentration: 26.5%), 29 parts of a styrene-butadiene-based latex (trade name: L-1571, manufactured by Asahi Kasei Chemicals Corporation, solids content concentration: 48%), 12.8 parts of a styrene-acrylic-based emulsion-type sizing agent (trade name: Polymaron E-100, manufactured by Arakawa Chemical Industries, Ltd., solids content concentration: 30%), 2.3 parts of carboxymethyl cellulose (trade name: Cellogen AG Gum, manufactured by Daiichi Kogyo Seiyaku Co., Ltd.), 0.2 parts of a 10% aqueous solution of a sodium dioctylsulfosuccinate salt (trade name: SN Wet OT-70, manufactured by San Nopco, Ltd.), 1 part of a 5% emulsion of a natural fat- and oil-based antifoaming agent (trade name: Nopco 1407H, manufactured by San Nopco, Ltd.), 4 parts of a 45% aqueous solution of a zirconium ammonium carbonate salt (trade name: Baycote 20, manufactured by Nippon Light Metal Company, Ltd.), and 73 parts of water.

Preparation of Coating Liquid for Undercoat Layer

A coating liquid for an undercoat layer was obtained by mixing and stirring a composition comprising 293 parts of a plastic hollow particle dispersion (trade name: Ropaque SN-1055, as described above), 22 parts of a styrene-butadiene-based latex (trade name: L-1571, as described above), 26 parts of a butyl ester of a styrene-maleic anhydride copolymer (trade name: Polymaron HAM-15, manufactured by Arakawa Chemical Industries, Ltd., solids content concentration: 15%), 2.4 parts of carboxymethyl cellulose (trade name: Cellogen AG Gum, as described above), 0.2 parts of a 10% aqueous solution of a sodium dioctylsulfosuccinate salt (trade name: SN Wet OT-70, as described above), 1 part of a 5% emulsion of a natural fat- and oil-based antifoaming agent (trade name: Nopco 1407H, as described above), and 4 parts of a 45% aqueous solution of a zirconium ammonium carbonate salt (trade name: Baycote 20, as described above).

Preparation of Liquid AI (Preparation of Leuco Dye Dispersion)

A liquid AI was obtained by pulverizing a composition comprising 100 parts of 3-di(n-butyl)-6-methyl-7-anilinofluoran, 50 parts of a 20% aqueous solution of sulfone-modified polyvinyl alcohol (trade name: Gohseran L-3266; manufactured by The Nippon Synthetic Chemical Industry Co., Ltd.), 10 parts of a 5% emulsion of a natural fat- and oil-based antifoaming agent (trade name: Nopco 1407H, as described above), and 90 parts of water using a sand mill until the average particle size was 0.5 μm.

Preparation of Liquid BI (Preparation of Coloring Agent Dispersion)

A liquid BI was obtained by pulverizing a composition comprising 100 parts of 4,4'-dihdroxydiphenylsulfone, 50 parts of a 20% aqueous solution of sulfone-modified polyvinyl alcohol (trade name: Gohseran L-3266; as described above), 10 parts of a 5% emulsion of a natural fat- and oil-based antifoaming agent (trade name: Nopco 1407H; as described above), and 90 parts of water using a sand mill until the average particle size was 1.0 μm.

Preparation of Liquid CI (Preparation of Sensitizer Dispersion)

A liquid CI was obtained by pulverizing a composition comprising 100 parts of diphenylsulfone, 50 parts of a 20% aqueous solution of sulfone-modified polyvinyl alcohol (trade name: Gohseran L-3266; as described above), 10 parts of a 5% emulsion of a natural fat- and oil-based antifoaming agent (trade name: Nopco 1407H; as described above), and 90 parts of water using a sand mill until the average particle size was 1.0 μm.

Preparation of Liquid DI (Preparation of Storage Stability Improving Agent Dispersion)

A liquid DI was obtained by pulverizing a composition comprising 100 parts of 4,4'-bis[(4-methyl-3-phenoxycarbonylaminophenyl)ureido]diphenylsulfone, 5 parts of magnesium silicate, 50 parts of a 20% aqueous solution of sulfone-modified polyvinyl alcohol (trade name: Gohseran L-3266; as described above), 10 parts of a 5% emulsion of a natural fat- and oil-based antifoaming agent (trade name: Nopco 1407H; as described above), and 90 parts of water using a sand mill until the average particle size was 1.0 μm.

Preparation of Coating Liquid for Thermosensitive Recording Layer

A coating liquid for a thermosensitive recording layer was obtained by mixing and stirring a composition comprising 38 parts of liquid AI, 106 parts of liquid BI, 30 parts of liquid CI, 11 parts of liquid DI, 11 parts of a 50% aqueous dispersion of kaolin (trade name: HG90, manufactured by KaMin LLC), 6 parts of a 60% aqueous dispersion of precipitated calcium carbonate (trade name: Brilliant 5-15, manufactured by Shiraishi Kogyo Co., Ltd.), 42 parts of an 8% aqueous solution of polyvinyl alcohol (PVA-124, manufactured by Kuraray Co., Ltd., polymerization degree: 2,400), 3.9 parts of a styrene-butadiene-based latex (trade name: L-1571, as described above), 7.5 parts of a 35% aqueous dispersion of dihydrazide adipate, 2.6 parts of a 10% aqueous solution of a sodium dioctylsulfosuccinate salt (trade name: SN Wet OT-70, as described above), 1.4 parts of a 5% emulsion of a natural fat- and oil-based antifoaming agent (trade name: Nopco 1407H; as described above), and 70 parts of water.

Preparation of Coating Liquid for Protective Layer

A coating liquid for a protective layer was obtained by mixing and stirring 108 parts of a 50% aqueous dispersion of kaolin (trade name: HG90, as described above), 7.4 parts of aluminum hydroxide (trade name: Higilite H-42, manufactured by Showa Denko Co., Ltd.), 270 parts of a 10% aqueous solution of diacetone-modified polyvinyl alcohol (trade name: DF-20, manufactured by Japan VAM & POVAL Co., Ltd., polymerization degree: 2,000), 112 parts of a 6% aqueous solution of polyvinyl alcohol (trade name: JC-40, manufactured by Japan VAM & POVAL Co., Ltd., polymerization degree: 4,000), 4.7 parts of an aqueous dispersion of zinc stearate (trade name: Hydrin Z-8-36, solids content concentration: 36%, manufactured by Chukyo Yushi Co., Ltd.), 2.6 parts of a polyethylene dispersion (trade name: Chemipearl W400, manufactured by Mitsui Chemicals Co., Ltd., solids content concentration: 40%), 5.7 parts of an ammonium salt of a hydrophobic polycarboxylic acid copolymer (trade name: Orotan 165A, manufactured by Dow Coating Materials Co., Ltd., solids content concentration: 21.8%), 1.1 parts of a 10% aqueous solution of a sodium dioctylsulfosuccinate salt (trade name: SN Wet OT-70, as described above), and 20 parts of a 5% emulsion of a natural fat- and oil-based antifoaming agent (trade name: Nopco 1407H, as described above).

Production of Thermosensitive Recording Material

An anchor layer (1) was formed by applying and drying a coating liquid for an anchor layer (1) on a paper support having a basis weight of 50 g/m$^2$ and a surface roughness of 8 μm under a pressure of 20 kg/cm$^2$ measured by a microtopograph so that the coated amount after drying was 6.0 g/m$^2$. An undercoat layer was formed by applying and drying a coating liquid for an undercoat layer on the obtained anchor layer (1) so that the coated amount after drying was 3.0 g/m$^2$. A thermosensitive recording layer was formed by applying and drying a coating liquid for a thermosensitive recording layer on the obtained undercoat layer so that the coated amount after drying was 3.0 g/m$^2$. Furthermore, a protective layer was formed by applying and drying a coating liquid for a protective layer on the thermosensitive recording layer so that the coated amount after drying was 2.5 g/m$^2$. The material was then smoothened with a super calender under pressurized conditions with a linear pressure of 78 N/m to obtain a thermosensitive recording material. The Stockigt sizing degree of the support was 10 seconds.

Working Example 1-2

A thermosensitive recording material was obtained in the same manner as in Working Example 1-1 with the exception that the amount of calcined kaolin was changed from 130 parts to 155 parts and that a plastic hollow particle dispersion was not used in the preparation of the coating liquid for the anchor layer (1) of Working Example 1-1.

Working Example 1-3

A thermosensitive recording material was obtained in the same manner as in Working Example 1-1 with the exception that the amount of calcined kaolin was changed from 130 parts to 62 parts and that the amount of the plastic hollow particle dispersion was changed from 48 parts to 176 parts in the preparation of the coating liquid for the anchor layer (1) of Working Example 1-1.

Working Example 1-4

A thermosensitive recording material was obtained in the same manner as in Working Example 1-1 with the exception that the amount of the styrene-acrylic-based emulsion-type sizing agent was changed from 12.8 parts to 3.3 parts in the preparation of the coating liquid for the anchor layer (1) of Working Example 1-1.

Working Example 1-5

A thermosensitive recording material was obtained in the same manner as in Working Example 1-1 with the exception that the amount of the styrene-acrylic-based emulsion-type sizing agent was changed from 12.8 parts to 30 parts in the preparation of the coating liquid for the anchor layer (1) of Working Example 1-1.

Working Example 1-6

A thermosensitive recording material was obtained in the same manner as in Working Example 1-1 with the exception that the amount of the butyl ester of the styrene-maleic anhydride copolymer was changed from 26 parts to 40 parts in the preparation of the coating liquid for the undercoat layer of Working Example 1-1.

Working Example 1-7

A thermosensitive recording material was obtained in the same manner as in Working Example 1-1 with the exception that the amount of the plastic hollow particle dispersion was changed from 293 parts to 176 parts and that 62 parts of a 50% aqueous dispersion of calcined kaolin (trade name: Ansilex-93, as described above) was added in the preparation of the coating liquid for the undercoat layer of Working Example 1-1.

Working Example 1-8

A thermosensitive recording material was obtained in the same manner as in Working Example 1-1 with the exception that a paper support having a basis weight of 50 g/m$^2$ and a surface roughness of 15 μm under a pressure of 20 kg/cm$^2$ measured with a microtopograph was used instead of the paper support having a basis weight of 50 g/m$^2$ and a surface roughness of 8 μm under a pressure of 20 kg/cm$^2$ measured with a microtopograph in the production of the thermosensitive recording material of Working Example 1-1. The Stockigt sizing degree of the support was 7 seconds.

Working Example 1-9

A thermosensitive recording material was obtained in the same manner as in Working Example 1-1 with the exception that a styrene-maleic acid copolymer ammonium salt (trade name: Polymaron 385, manufactured by Arakawa Chemical Industries, Ltd., solids content concentration: 25%) was used instead of the styrene-acrylic-based emulsion-type sizing agent in the preparation of the coating liquid for the anchor layer (1) of Working Example 1-1.

Working Example 1-10

A thermosensitive recording material was obtained in the same manner as in Working Example 1-1 with the exception that 16 parts of an olefin-maleic acid copolymer ammonium salt (Polymaron 1329, manufactured by Arakawa Chemical Industries, Ltd., solids content concentration: 25%) was used instead of 26 parts of the butyl ester of the styrene-maleic anhydride copolymer in the preparation of the coating liquid for the undercoat layer of Working Example 1-1.

Working Example 1-11

A thermosensitive recording material was obtained in the same manner as in Working Example 1-1 with the exception that the amount of calcined kaolin was changed from 130 parts to 110 parts and that the amount of the plastic hollow particle dispersion was changed from 48 parts to 90 parts in the preparation of the coating liquid for the anchor layer (1) of Working Example 1-1.

Working Example 1-12

A thermosensitive recording material was obtained in the same manner as in Working Example 1-1 with the exception that the amount of the butyl ester of the styrene-maleic anhydride copolymer was changed from 26 parts to 16 parts in the preparation of the coating liquid for the undercoat layer of Working Example 1-1.

Comparative Example 1-1

A thermosensitive recording material was obtained in the same manner as in Working Example 1-1 with the exception that a styrene-acrylic-based emulsion-type sizing agent was not used in the preparation of the coating liquid for the anchor layer (1) of Working Example 1-1.

The following evaluations were performed for the thermosensitive recording materials obtained as described above. The results are shown in Table 1.

(Recording Performance 1: Color Developability)

A checkered pattern was recorded using a label printer (trade name: L-2000, manufactured by Ishida), and the reflection density (recording density) of the recorded part was measured with a spectral colorimetric optical densitometer (trade name: X-rite Type 939, manufactured by X-rite Co., Ltd.). Larger values indicate higher printing densities, which is preferable. For the recorded part, practically, the value is preferably 1.20 or greater.

(Test Performance 1: Image Quality 1)

A bar code was recorded using a label printer (trade name: L-2000, manufactured by Ishida), and the recording image quality thereof was observed visually and evaluated under the following criteria.

○: No problems whatsoever, with no printing voids in the image or thickening of the bar code.

Δ: No problems from a practical perspective, with practically no printing voids in the image or thickening of the bar code.

x: Problematic from a practical perspective, with printing voids in the image or thickening of the bar code.

(Test Performance 1: Image Quality 2)

The continuous tone from the reflection density level of the background part (unrecorded part) to the saturation concentration (recorded part) was recorded in one image using a thermosensitive recording evaluation device (trade name: TH-PMH, manufactured by Okura Denki Co., Ltd.), and the half tone recording quality was observed visually and evaluated under the following criteria.

◎: Uniform image quality with no color unevenness.

○: No problems from a practical perspective, with practically no color unevenness.

Δ: Problematic from a practical perspective, with noticeable striped color unevenness x: Non-uniform image quality substantial color unevenness.

(Recording Performance 2: Color Developability)

An adhesive layer was provided by applying an acrylic resin-based adhesive at 20 g/m$^2$ to a support on the side (back side) opposite to the thermosensitive recording layer of each thermosensitive recording material, and the material was processed into a thermosensitive recording label (glue processing) by attaching a high-quality release sheet to the adhesive layer. Furthermore, as an accelerated test for evaluating the color-developing reaction (glue desensitization) due to the adhesive component after being processed into a thermosensitive recording label, the material was stored for seven days in an environment at 40° C. and 90% RH, and the recording density was then measured with the same method as in the case of recording performance 1. Furthermore, the print reproducibility was determined from the following formula, and the recording performance was evaluated under the following criteria. The "recording density prior to label processing" is the value obtained in "Recording performance 1: color developability".

Print reproducibility (%)=(recording density after being stored after label processing/recording density prior to label processing)×100

○: No problems whatsoever as long as the print reproducibility is at least 85%.

Δ: No problems from a practical perspective as long as the print reproducibility is at least 70% and less than 85%.

x: Problematic from a practical perspective when the print reproducibility is less than 70%.

(Test Performance 2: Image Quality 1)

After the material was stored after label processing with the same method as in "Recording performance 2: color developability", evaluations were made with the same method as in "Recording performance 1: image performance 1".

TABLE 1

| | Test performance 1 | | | Test performance 2 | | | |
|---|---|---|---|---|---|---|---|
| | Color developability | Image quality 1 | Image quality 2 | Color developability | Reproduction rate | Evaluation | Image quality 1 |
| Working Example 1-1 | 1.38 | ○ | ◎ | 1.32 | 96% | ○ | ○ |
| Working Example 1-2 | 1.35 | Δ | ○ | 1.28 | 95% | ○ | Δ |
| Working Example 1-3 | 1.40 | Δ | ○ | 1.33 | 95% | ○ | Δ |
| Working Example 1-4 | 1.38 | ○ | ◎ | 1.17 | 85% | ○ | ○ |
| Working Example 1-5 | 1.28 | ○ | ◎ | 1.23 | 96% | ○ | ○ |
| Working Example 1-6 | 1.30 | ○ | ◎ | 1.25 | 96% | ○ | ○ |
| Working Example 1-7 | 1.32 | ○ | ◎ | 1.19 | 90% | ○ | ○ |
| Working Example 1-8 | 1.31 | Δ | ○ | 1.23 | 93% | ○ | Δ |
| Working Example 1-9 | 1.37 | ○ | ◎ | 1.14 | 83% | Δ | Δ |
| Working Example 1-10 | 1.36 | ○ | ◎ | 1.13 | 83% | Δ | Δ |
| Working Example 1-11 | 1.39 | ○ | ◎ | 1.33 | 96% | ○ | ○ |
| Working Example 1-12 | 1.35 | ○ | ◎ | 1.30 | 96% | ○ | ○ |
| Comparative Example 1-1 | 1.35 | Δ | Δ | 0.90 | 67% | X | X |

Working Example 2-1

Preparation of Coating Liquid for Anchor Layer (1)

A coating liquid for an anchor layer (1) was prepared with the same method as in "Preparation of coating liquid for anchor layer (1)" of Working Example 1-1 described above.

Preparation of Coating Liquid for Undercoat Layer

A coating liquid for an undercoat layer was prepared with the same method as in "Preparation of coating liquid for undercoat layer" of Working Example 1-1 described above.

Preparation of Coating Liquid for Thermosensitive Recording Layer

A coating liquid for a thermosensitive recording layer was prepared with the same method as in "Preparation of coating liquid for thermosensitive recording layer (1)" of Working Example 1-1 described above.

Preparation of Coating Liquid for Protective Layer

A coating liquid for a protective layer was prepared with the same method as in "Preparation of coating liquid for protective layer" of Working Example 1-1 described above.

Production of Thermosensitive Recording Material

An anchor layer (1) was formed by applying and drying a coating liquid for an anchor layer (1) on a neutral paper (hot water extraction pH: 8.8) containing calcium carbonate as a basic pigment having a basis weight of 53 g/m$^2$ and a surface roughness of 7 μm under a pressure of 20 kg/cm$^2$ measured by a microtopograph so that the coated amount after drying was 6.0 g/m$^2$. An undercoat layer was formed by applying and drying a coating liquid for an undercoat layer on the obtained anchor layer (1) so that the coated amount after drying was 3.0 g/m$^2$. A thermosensitive recording layer was formed by applying and drying a coating liquid for a thermosensitive recording layer on the obtained undercoat layer so that the coated amount after drying was 3.0 g/m$^2$. Furthermore, a protective layer was formed by applying and drying a coating liquid for a protective layer on the thermosensitive recording layer so that the coated amount after drying was 2.5 g/m$^2$. The material was then smoothened with a super calender under pressurized conditions with a linear pressure of 78 N/m to obtain a thermosensitive recording material. The Stockigt sizing degree of the support was 9 seconds. In addition, the Oken-type air permeability of the support was 72 seconds.

Working Example 2-2

A thermosensitive recording material was obtained in the same manner as in Working Example 2-1 with the exception that N-p-tolylsulfonyl-N'-3-(p-tolylsulfonyloxy)phenylurea was used instead of 4,4'-dihydroxydiphenylsulfone in the preparation of liquid BI in Working Example 2-1 (preparation of coloring agent dispersion).

Working Example 2-3

A thermosensitive recording material was obtained in the same manner as in Working Example 2-1 with the exception that the amount of calcined kaolin was changed from 130 parts to 155 parts and that a plastic hollow particle dispersion was not used in the preparation of the coating liquid for the anchor layer (1) of Working Example 2-1.

Working Example 2-4

A thermosensitive recording material was obtained in the same manner as in Working Example 2-1 with the exception that a styrene-maleic acid copolymer ammonium salt (trade name: Polymaron 385, manufactured by Arakawa Chemical Industries, Ltd., solids content concentration: 25%) was used instead of the styrene-acrylic-based emulsion-type sizing agent in the preparation of the coating liquid for the anchor layer (1) of Working Example 2-1.

Working Example 2-5

A thermosensitive recording material was obtained in the same manner as in Working Example 2-1 with the exception that 16 parts of an olefin-maleic acid copolymer ammonium salt (Polymaron 1329, manufactured by Arakawa Chemical Industries, Ltd., solids content concentration: 25%) was used instead of 26 parts of the butyl ester of the styrene-maleic anhydride copolymer in the preparation of the coating liquid for the undercoat layer of Working Example 2-1.

Working Example 2-6

A thermosensitive recording material was obtained in the same manner as in Working Example 2-1 with the exception that a neutral paper (hot water extraction pH: 6.5) containing calcium carbonate as a basic pigment having a basis weight of 53 g/m$^2$ and a surface roughness of 12 μm under a pressure of 20 kg/cm$^2$ measured with a microtopograph was used instead of a neutral paper having a basis weight of 53 g/m$^2$ and a surface roughness of 7 μm under a pressure of 20 kg/cm$^2$ measured with a microtopograph as a support containing a basic pigment in the production of the thermosensitive recording material of Working Example 2-1. The Stockigt sizing degree of the support was 6 seconds. In addition, the Oken-type air permeability of the support was 17 seconds.

Comparative Example 2-1

A thermosensitive recording material was obtained in the same manner as in Working Example 2-1 with the exception that a styrene-acrylic-based emulsion-type sizing agent was not used in the preparation of the coating liquid for the anchor layer (1) of Working Example 2-1.

The following evaluations were performed for the thermosensitive recording materials obtained as described above. The results are shown in Table 2.

The recording performance 1 (color developability, image quality 1, and image quality 2) and the recording performance 2 (color developability and image quality 1) were evaluated with the same method as in Working Example 1-1 described above. In addition, the blank-paper preservability was evaluated by the following method.

(Blank-Paper Preservability: Color Developability)

After a thermosensitive recording material was stored for seven days in an environment at 40° C. and 90% RH as an accelerated test in the blank paper (unrecorded) state prior to recording, a checkered pattern was recorded using a label printer (trade name: L-2000, manufactured by Ishida), and the reflection density (recording density) of the recorded part was measured with a spectral colorimetric optical densitometer (trade name: X-rite Type 939, manufactured by X-rite Co., Ltd.). Furthermore, the print reproduction rate was determined from the following formula, and the recording performance was evaluated under the following criteria. The "recording density prior to storage" is the value obtained in "Recording performance 1: color developability".

Print reproducibility (%)=(recording density after storage/recording density prior to storage)×100

○: No problems whatsoever as long as the print reproducibility is at least 85%.

Δ: No problems from a practical perspective as long as the print reproducibility is at least 70% and less than 85%.

x: Problematic from a practical perspective when the print reproducibility is less than 70%.

TABLE 2

| | Recording performance 1 | | | Recording performance 2 | | | | Blank-paper preservability | | |
|---|---|---|---|---|---|---|---|---|---|---|
| | Color developability | Image quality 1 | Image quality 2 | Color developability | Reproduction rate | Evaluation | Image quality 1 | Color developability | Reproduction rate | Evaluation |
| Working Example 2-1 | 1.38 | ○ | ◎ | 1.32 | 96% | ○ | ○ | 1.31 | 95% | ○ |
| Working Example 2-2 | 1.31 | ○ | ◎ | 1.24 | 95% | ○ | ○ | 1.22 | 93% | ○ |
| Working Example 2-3 | 1.35 | Δ | ○ | 1.28 | 95% | ○ | Δ | 1.23 | 91% | ○ |
| Working Example 2-4 | 1.37 | ○ | ◎ | 1.14 | 83% | Δ | Δ | 1.11 | 81% | Δ |
| Working Example 2-5 | 1.36 | ○ | ◎ | 1.13 | 83% | Δ | Δ | 1.12 | 82% | Δ |
| Working Example 2-6 | 1.38 | ○ | ◎ | 1.32 | 96% | ○ | ○ | 1.32 | 96% | ○ |
| Comparative Example 2-1 | 1.35 | Δ | Δ | 0.90 | 67% | X | X | 0.89 | 66% | X |

Working Example 3-1

Preparation of Coating Liquid for Anchor Layer (2)

A coating liquid for an anchor layer (2) was obtained by mixing and stirring a composition comprising 40 parts of a styrene-butadiene copolymer latex (solids content concentration: 50%), 50 parts of a 10% aqueous solution of oxidized starch, 1 part of carboxymethyl cellulose (trade name: Cellogen AG Gum, manufactured by Daiichi Kogyo Seiyaku Co., Ltd.), and 15 parts of an ammonium salt of a styrene-maleic anhydride copolymer (Polymaron WR300DS, solids content concentration: 20%, manufactured by Arakawa Chemical Industries, Ltd.) into a dispersion obtained by dispersing 85 parts of calcined kaolin: (trade name: Ansilex-93, manufactured by BASF, oil absorption: 90 mL/100 g) in 100 parts of water.

Preparation of Leuco Dye Dispersion (Liquid AII)

A liquid AII was obtained by pulverizing a composition comprising 10 parts of 3-(N-ethyl-p-toluidino)-6-methyl-7-anilinofluoran, 5 parts of a 5% aqueous solution of methyl cellulose, and 15 parts of water using a sand mill until the average particle size was 0.5 μm.

Preparation of Coloring Agent Dispersion (Liquid BII)

A liquid BII was obtained by pulverizing a composition comprising 10 parts of 2,4'-dihydroxydiphenylsulfone, 5 parts of a 5% aqueous solution of methyl cellulose, and 15 parts of water using a sand mill until the average particle size was 0.8 μm.

Preparation of Sensitizer Dispersion (Liquid CII)

A liquid CII was obtained by pulverizing a composition comprising 20 parts of a di-p-methylbenzyl oxalate ester, 5 parts of a 5% aqueous solution of methyl cellulose, and 55 parts of water using a sand mill until the average particle size was 0.8 μm.

Preparation of Coating Liquid for Thermosensitive Recording Layer

A coating liquid for a thermosensitive recording layer was obtained by mixing and stirring a composition comprising 25 parts of liquid AII, 50 parts of liquid BII, 50 parts of liquid CII, 20 parts of a fine particulate amorphous silica dispersion (trade name: Silojet 703A, average particle size: 0.3 μm, solids content concentration: 20%, manufactured by Grace Davison Co., Ltd.), 30 parts of a 20% aqueous solution of oxidized starch, 50 parts of a 10% aqueous solution of acetoacetyl-modified polyvinyl alcohol (trade name: Gohsefimer-Z-200, manufactured by The Nippon Synthetic Chemical Industry Co., Ltd.), and 2 parts of a polyethylene dispersion (trade name: Chemipearl W-400, solids content concentration: 20%, manufactured by Mitsui Chemicals Co., Ltd.).

Preparation of Coating Liquid for Protective Layer

A coating liquid for a protective layer was obtained by mixing and stirring a dispersion obtained by dispersing 50 parts of kaolin (trade name: UW-90, manufactured by BASF) in 100 parts of water, 600 parts of a 10% aqueous solution of acetoacetyl-modified polyvinyl alcohol (trade name: Gohsefimer-Z-200, as described above), and 25 parts of zinc stearate (trade name: Hydrin Z-8-36, solids content concentration: 36%, manufactured by Chukyo Yushi Co., Ltd.).

Production of Thermosensitive Recording Material

An anchor layer (2) was formed by applying and drying a coating liquid for the anchor layer (2) to one surface of woodfree paper having a basis weight of 50 g/m$^2$ so that the coated amount after drying was 5.0 g/m$^2$. A thermosensitive recording layer was formed by applying and drying a coating liquid for a thermosensitive recording layer on the anchor layer (2) so that the coated amount after drying was 4.0 g/m$^2$. A protective layer was formed by applying and drying a coating liquid for a protective layer on the thermosensitive recording layer so that the coated amount after drying was 1.5 g/m$^2$. The material was then smoothened with a super calender under pressurized conditions with a linear pressure of 78 N/m to obtain a thermosensitive recording material.

Working Example 3-2

A thermosensitive recording material was obtained in the same manner as in Working Example 3-1 with the exception that the amount of the ammonium salt of the styrene-maleic acid copolymer was changed from 15 parts to 5 parts in the preparation of the coating liquid for the anchor layer (2) of Working Example 3-1.

Working Example 3-3

A thermosensitive recording material was obtained in the same manner as in Working Example 3-1 with the exception that an ammonium salt of a styrene-acrylic acid copolymer (Polymaron PM326, solids content concentration: 20%, manufactured by Arakawa Chemical Industries, Ltd.) was used instead of an ammonium salt of a styrene-maleic acid copolymer in the preparation of the coating liquid for the anchor layer (2) of Working Example 3-1.

Working Example 3-4

A thermosensitive recording material was obtained in the same manner as in Working Example 3-1 with the exception that the amount of the ammonium salt of the styrene-maleic acid copolymer was changed from 15 parts to 3 parts in the preparation of the coating liquid for the anchor layer (2) of Working Example 3-1.

Working Example 3-5

A thermosensitive recording material was obtained in the same manner as in Working Example 3-1 with the exception that the amount of the ammonium salt of the styrene-maleic acid copolymer was changed from 15 parts to 20 parts in the preparation of the coating liquid for the anchor layer (2) of Working Example 3-1.

Comparative Example 3-1

A thermosensitive recording material was obtained in the same manner as in Working Example 3-1 with the exception that 15 parts of an ammonium salt of a styrene-maleic acid copolymer was not added in the preparation of the coating liquid for the anchor layer (2) of Working Example 3-1.

Comparative Example 3-2

A thermosensitive recording material was obtained in the same manner as in Working Example 3-1 with the exception that the amount of the ammonium salt of the styrene-maleic acid copolymer was changed from 15 parts to 40 parts in the preparation of the coating liquid for the anchor layer (2) of Working Example 3-1.

Comparative Example 3-3

A thermosensitive recording material was obtained in the same manner as in Working Example 3-1 with the exception that a sodium salt of an isobutylene-maleic anhydride copolymer (Isoban 600SF35, solids content concentration: 20%, manufactured by Kuraray Co., Ltd.) was used instead of an ammonium salt of a styrene-maleic acid copolymer in the preparation of the coating liquid for the anchor layer (2) of Working Example 3-1.

The following evaluations were performed for the thermosensitive recording materials obtained as described above. The results are shown in Table 3.

(Recording Color Developability Prior to Thermosensitive Recording Label Processing)

A checkered pattern was recorded with each thermosensitive recording material using a label printer (trade name: L-2000, manufactured by Ishida), and the optical density (recording density) of the recorded part was measured with a spectral colorimetric optical densitometer (trade name: X-rite Type 939, manufactured by X-rite Co., Ltd.).

(Recording Image Quality Prior to Thermosensitive Recording Label Processing)

The image quality of the recording image obtained in the evaluation of the recording color developability described above was observed visually and evaluated under the following criteria.

◎: There are practically no printing voids in the image.

○: There are a few printing voids in the image, but there is no problem from a practical perspective.

x: There are many printing voids in the image.

(Recording Color Developability after Thermosensitive Recording Label Processing)

Thermosensitive recording label processing was performed by applying an acrylic resin-based adhesive to the surface (back surface) on the opposite side to the recording surface of each thermosensitive recording material and attaching a silicone-processed release surface of a release sheet containing woodfree paper as a base material to the surface, and after the material was stored for seven days under accelerated conditions in an environment at 40° C. and 90% RH, the optical density of the recorded part was measured in the same manner as in the evaluation of the recording color developability prior to thermosensitive recording label processing described above.

(Recording Image Quality after Thermosensitive Recording Label Processing)

The image quality of the recording image obtained in the evaluation of the recording color developability after thermosensitive recording label processing described above was evaluated in the same manner as in the evaluation of the recording image quality prior to thermosensitive recording label processing.

TABLE 3

| | Prior to thermosensitive recording label processing | | After thermosensitive recording label processing | |
|---|---|---|---|---|
| | Recording color developability | Recording image quality | Recording color developability | Recording image quality |
| Working Example 3-1 | 1.33 | ◎ | 1.28 | ◎ |
| Working Example 3-2 | 1.30 | ◎ | 1.25 | ◎ |
| Working Example 3-3 | 1.31 | ◎ | 1.26 | ◎ |
| Working Example 3-4 | 1.30 | ○ | 1.18 | ○ |
| Working Example 3-5 | 1.26 | ◎ | 1.22 | ◎ |
| Comparative Example 3-1 | 1.30 | ○ | 0.90 | X |
| Comparative Example 3-2 | 1.15 | ○ | 1.10 | ○ |
| Comparative Example 3-3 | 1.32 | ○ | 0.95 | X |

Working Example 4-1

Preparation of Coating Liquid for Anchor Layer (2)

A coating liquid for an anchor layer (2) was obtained by mixing and stirring a composition comprising 115 parts of a hollow plastic particle dispersion (trade name: ROPAQUE SN-1055; hollo ratio: 55%; average particle size: 1.0 μm; manufactured by Dow Chemical Co., Ltd.; solids content concentration: 26.5 mass %), 100 parts of a 50% aqueous dispersion (volume-average particle size: 0.6 μm) of calcined kaolin (trade name: Ansilex; manufactured by BASF), 20 parts of a styrene-butadiene-based latex (trade name: L-1571; manufactured by Asahi Kasei Chemicals Corporation; solids content concentration: 48 mass %), 20 parts of an ammonium salt of an anionic styrene-maleic acid copolymer as a sizing agent (trade name: Polymaron WR300DS, manufactured by Arakawa Chemical Industries, Ltd., solids content concentration: 20%), 30 parts of a 10% aqueous solution of oxidized starch, and 20 parts of water.

Preparation of Liquid AIII (Leuco Dye Dispersion)

A liquid AIII was obtained by pulverizing a composition comprising 100 parts of 3-di(n-butyl)amino-6-methyl-7-anilinofluoran, 50 parts of a 20% aqueous solution of sulfone-modified polyvinyl alcohol (trade name: Gohseran L-3266; manufactured by The Nippon Synthetic Chemical Industry Co., Ltd.), 10 parts of a 5% emulsion of a natural fat- and oil-based antifoaming agent (trade name: Nopco 1407H; manufactured by San Nopco Ltd.), and 90 parts of water using a sand mill until the median diameter measured with an SALD 2200 laser diffraction-type particle size distribution measuring apparatus (manufactured by the Shimadzu Corporation) was 0.5 μm.

Preparation of Liquid BIII (Coloring Agent Dispersion)

A liquid BIII was obtained by pulverizing a composition comprising 100 parts of N-[2-(3-phenylureido)phenyl]benzenesulfonamide, 50 parts of a 20% aqueous solution of sulfone-modified polyvinyl alcohol (trade name: Gohseran L-3266, as described above), 10 parts of a 5% emulsion of a natural fat- and oil-based antifoaming agent (trade name: Nopco 1407H, as described above), and 90 parts of water using a sand mill until the median diameter measured with a SALD 2200 laser diffraction-type particle size distribution measuring apparatus (manufactured by the Shimadzu Corporation) was 0.6 μm.

Preparation of Liquid CIII (Sensitizer Dispersion)

A liquid CIII was obtained by pulverizing a composition comprising 100 parts of 1,2-di(3-methylphenoxy)ethane, 50 parts of a 20% aqueous solution of sulfone-modified polyvinyl alcohol (trade name: Gohseran L-3266, as described above), 2 parts of a 5% emulsion of a natural fat- and oil-based antifoaming agent (trade name: Nopco 1407H, as described above), and 98 parts of water using a sand mill until the median diameter measured with an SALD 2200 laser diffraction-type particle size distribution measuring apparatus (manufactured by the Shimadzu Corporation) was 1.0 μm.

Preparation of Coating Liquid for Thermosensitive Recording Layer

A coating liquid for a thermosensitive recording layer was obtained by mixing a composition comprising 35 parts of liquid AIII, 70 parts of liquid BIII, 35 parts of liquid CIII, 24 parts of aluminum hydroxide (trade name: Higilite H-42, manufactured by Showa Denko Co., Ltd.), 120 parts of a 10% aqueous solution of polyvinyl alcohol having a degree of saponification of 98 mol % and a polymerization degree of 1,000, 5 parts of a 35% aqueous dispersion of dihydrazide adipate, 2 parts of a 10% aqueous solution of a sodium dioctylsulfosuccinate salt, and 35 parts of water.

Preparation of Liquid DIII (Kaolin Dispersion)

A liquid DIII was obtained by mixing a composition comprising 50 parts of kaolin [trade name: UW-90 (registered trademark), manufactured by BASF], 4 parts of fine particulate amorphous silica (trade name: Mizukasil P-527, manufactured by Mizusawa Industrial Chemicals, Ltd.), 0.4 parts of a 40% aqueous solution of sodium polyacrylate (trade name: Aron T-50, manufactured by Toagosei Co., Ltd.), and 81 parts of water.

Preparation of Coating Liquid for Protective Layer

A coating liquid for a protective layer was obtained by mixing a composition comprising 135 parts of liquid DIII, 250 parts of a 10% aqueous solution of acetoacetyl-modified polyvinyl alcohol (trade name: Gohsefimer-Z-200, polymerization degree: 1,000, manufactured by The Nippon Synthetic Chemical Industry Co., Ltd.), 20 parts of an aqueous dispersion of zinc stearate (trade name: Hydrin Z-8-36, solids content concentration: 36%, manufactured by Chukyo Yushi Co., Ltd.), 45 parts of an ionomer-type urethane-based resin latex (trade name: Hydran (registered trademark) AP-30F, manufactured by the DIC Corporation, solids content concentration: 20%), and 1 part of a 10% aqueous solution of a sodium dioctylsulfosuccinate salt.

Production of Thermosensitive Recording Material

An anchor layer (2) was formed by applying the coating liquid for the anchor layer (2) to one surface of woodfree paper (acidic paper) having a basis weight of 64 g/m$^2$ with a blade coating method and drying so that the weight after drying was 7 g/m$^2$, and a thermosensitive recording layer was formed by applying the coating liquid for the thermosensitive recording layer to the anchor layer (2) with a curtain coating method using a slide hopper-type curtain coating device and drying so that the weight after drying was 3.5 g/m$^2$. After a protective layer was formed by applying the coating liquid for the protective layer to the thermosensitive recording layer with a curtain coating method and drying so that the coated amount after drying was 2.5 g/m$^2$, the material was subjected to super calender treatment so as to obtain a thermosensitive recording material.

Production of Thermosensitive Recording Material Processed into an Adhesive Label An adhesive layer containing an acrylic-based resin adhesive as a main component was provided on the release surface of a release base paper in an amount of 20 g/m$^2$, and the adhesive layer was attached to the other surface of the woodfree paper to obtain a thermosensitive recording material processed into an adhesive label.

Working Example 4-2

A thermosensitive recording material processed into an adhesive label was obtained in the same manner as in Working Example 4-1 with the exception that the amount of the sizing agent was changed from 20 parts to 10 parts in the preparation of the coating liquid for the anchor layer (2) of Working Example 4-1.

Working Example 4-3

A thermosensitive recording material processed into an adhesive label was obtained in the same manner as in Working Example 4-1 with the exception that the amount of the sizing agent was changed from 20 parts to 50 parts in the preparation of the coating liquid for the anchor layer (2) of Working Example 4-1.

Working Example 4-4

A thermosensitive recording material processed into an adhesive label was obtained in the same manner as in Working Example 4-1 with the exception that the type and amount of the sizing agent were changed to 13.5 parts of an anionic styrene-acrylic acid copolymer resin (trade name: Polymaron E-100, manufactured by Arakawa Chemical Industries, Ltd., solids content concentration: 30%) in the preparation of the coating liquid for the anchor layer (2) of Working Example 4-1.

Preparation of Liquid E (Coloring Agent Dispersion)

A liquid E was obtained by pulverizing a composition comprising 100 parts of a compound represented by general formula (2) above (trade name: UU, manufactured by Chemipro Kasei Co., Ltd.), 50 parts of a 20% aqueous solution of sulfone-modified polyvinyl alcohol (trade name: Gohseran L-3266, as described above), 2 parts of a 5% emulsion of a natural fat- and oil-based antifoaming agent (trade name: Nopco 1407H, as described above), and 98 parts of water using a sand mill until the median diameter measured with an SALD 2200 laser diffraction-type particle size distribution measuring apparatus (manufactured by the Shimadzu Corporation) was 1.0 μm.

Working Example 4-5

A thermosensitive recording material processed into an adhesive label was obtained in the same manner as in Working Example 4-1 with the exception that 25 parts of liquid E was further added in the preparation of the coating liquid for the thermosensitive recording layer of Working Example 4-1.

Working Example 4-6

A thermosensitive recording material processed into an adhesive label was obtained in the same manner as in Working Example 4-5 with the exception that the amount of liquid BIII was changed from 70 parts to 90 parts and that the amount of liquid E was changed from 25 parts to 5 parts in the preparation of the coating liquid for the thermosensitive recording layer of Working Example 4-5.

Working Example 4-7

A thermosensitive recording material processed into an adhesive label was obtained in the same manner as in Working Example 4-5 with the exception that the amount of liquid BIII was changed from 70 parts to 35 parts and that the amount of liquid E was changed from 25 parts to 60 parts in the preparation of the coating liquid for the thermosensitive recording layer of Working Example 4-5.

Preparation of Liquid F (Coloring Agent Dispersion)

A dispersion was obtained by pulverizing a composition comprising 100 parts of 4,4'-bis[(4-methyl-3-phenoxycarbonlaminophenyl)ureido]diphenylsulfone, 5 parts of magnesium silicate, 50 parts of a 20% aqueous solution of sulfone-modified polyvinyl alcohol (trade name: Gohseran L-3266; manufactured by The Nippon Synthetic Chemical Industry Co., Ltd.), 10 parts of a 5% emulsion of a natural fat- and oil-based antifoaming agent (trade name: Nopco 1407H; manufactured by San Nopco Ltd.), and 90 parts of water using a sand mill until the median diameter measured with an SALD 2200 laser diffraction-type particle size distribution measuring apparatus (manufactured by the Shimadzu Corporation) was 1.0 μm. Furthermore, the dispersion was subjected to heat treatment for four hours at 70° C. to obtain a liquid F.

Working Example 4-8

A thermosensitive recording material processed into an adhesive label was obtained in the same manner as in Working Example 4-5 with the exception that liquid F was used instead of liquid E in the preparation of the coating liquid for the thermosensitive recording layer of Working Example 4-5.

Comparative Example 4-1

A thermosensitive recording material processed into an adhesive label was obtained in the same manner as in Working Example 4-1 with the exception that an anionic styrene-maleic acid copolymer resin was not used as a sizing agent in the preparation of the coating liquid for the anchor layer (2) of Working Example 4-1.

Comparative Example 4-2

A thermosensitive recording material processed into an adhesive label was obtained in the same manner as in Working Example 4-1 with the exception that 20 parts of a cationic alkyl ketene dimer-based emulsion (trade name: Size Pine K921, 20% concentration, manufactured by Arakawa Chemical Industries, Ltd.) was used as a sizing agent instead of 20 parts of an anionic styrene-maleic acid copolymer resin in the preparation of the coating liquid for the anchor layer (2) of Working Example 4-1.

The following evaluations were performed for the adhesive labels for thermosensitive recording obtained as described above. The results are shown in Table 4.

Recording Density

Each of the thermosensitive recording materials was printed using an applied energy of 0.16 mJ/dot and 0.28 mJ/dot by a thermosensitive recording evaluation device (trade name: TH-PMH; manufactured by Ohkura Electric Co., Ltd.). The optical densities of the recorded parts were measured using the visual mode of a reflection densitometer (trade name: Macbeth Densitometer RD-918; manufactured by GretagMacbeth). Larger values indicate higher printing densities.

Alcohol Resistance

Each of the thermosensitive recording materials colored using an applied energy of 0.28 mJ/dot was immersed in a 20% ethanol solution for 30 minutes using a thermosensitive recording evaluation device (trade name: TH-PMH; manufactured by Ohkura Electric Co., Ltd.). After the materials were dried, the optical densities of the recorded parts were measured using the visual mode of a reflection densitometer (trade name: Macbeth Densitometer RD-918; manufactured by GretagMacbeth). The storage stability of the recorded part was also determined by the following formula.

Storage stability (%)=(recording density after treatment/recording density before treatment)×100

Resistance to Plasticizers

A wrap film (trade name: Hi-Wrap KMA-W, manufactured by Mitsui Chemicals Co., Ltd.) was wrapped around a polycarbonate pipe (diameter: 40 mm) three times, and each thermosensitive recording material, which was colored for the recording density measurement, was placed thereon. Furthermore, a wrap film was wrapped three times around the material, and the assembly was left for 24 hours in an environment at 40° C. The density of the recorded part was measured using the visual mode of a reflection densitometer (trade name: Macbeth Densitometer RD-914; manufactured by Macbeth). The storage stability of the recorded part was also determined by the following formula.

Storage stability (%)=(recording density after treatment/recording density before treatment)×100

(Color Developability after Long-Term Storage)

In order to evaluate changes in recording sensitivity due to long-term storage, the thermosensitive recording material was stored for three days in an environment at 50° C. and 90% RH as an accelerated test. Each of the thermosensitive recording materials was then printed using an applied energy of 0.16 mJ/dot and 0.28 mJ/dot by a thermosensitive recording evaluation device (trade name: TH-PMH; manufactured by Ohkura Electric Co., Ltd.). The optical densities of the recorded parts were measured using the visual mode of a reflection densitometer (trade name: Macbeth Densitometer RD-918; manufactured by GretagMacbeth). A smaller difference in the recording density relative to the value prior to storage indicates that there are no color defects and that the material has excellent blank-paper preservability.

TABLE 4-1

| | Recording density | | | Alcohol resistance | |
|---|---|---|---|---|---|
| | Background part | 0.16 mJ/dot | 0.28 mJ/dot | Recorded part | Storage stability |
| Working Example 4-1 | 0.06 | 1.16 | 1.36 | 1.20 | 88% |
| Working Example 4-2 | 0.06 | 1.16 | 1.36 | 1.20 | 88% |
| Working Example 4-3 | 0.06 | 1.15 | 1.35 | 1.19 | 88% |
| Working Example 4-4 | 0.06 | 1.15 | 1.35 | 1.19 | 88% |
| Working Example 4-5 | 0.08 | 1.16 | 1.35 | 1.28 | 95% |
| Working Example 4-6 | 0.07 | 1.16 | 1.36 | 1.26 | 93% |
| Working Example 4-7 | 0.08 | 1.16 | 1.34 | 1.30 | 97% |
| Working Example 4-8 | 0.06 | 1.15 | 1.35 | 1.28 | 95% |
| Comparative Example 4-1 | 0.06 | 1.17 | 1.36 | 1.20 | 88% |
| Comparative Example 4-2 | 0.06 | 1.10 | 1.33 | 1.15 | 86% |

TABLE 4-2

| | Resistance to plasticizers | | Color developability after long-term storage | | | |
|---|---|---|---|---|---|---|
| | Recorded part | Degree of preservability | 0.16 mJ/dot | Density difference | 0.28 mJ/dot | Density difference |
| Working Example 4-1 | 1.25 | 92% | 1.14 | 0.02 | 1.35 | 0.01 |
| Working Example 4-2 | 1.25 | 92% | 1.13 | 0.03 | 1.34 | 0.02 |
| Working Example 4-3 | 1.24 | 92% | 1.13 | 0.02 | 1.34 | 0.01 |
| Working Example 4-4 | 1.24 | 92% | 1.11 | 0.04 | 1.33 | 0.02 |
| Working Example 4-5 | 1.31 | 97% | 1.14 | 0.02 | 1.34 | 0.01 |
| Working Example 4-6 | 1.29 | 95% | 1.14 | 0.02 | 1.35 | 0.01 |
| Working Example 4-7 | 1.32 | 99% | 1.14 | 0.02 | 1.33 | 0.01 |
| Working Example 4-8 | 1.31 | 97% | 1.14 | 0.01 | 1.34 | 0.01 |
| Comparative Example 4-1 | 1.25 | 92% | 0.97 | 0.20 | 1.24 | 0.12 |
| Comparative Example 4-2 | 1.19 | 89% | 0.90 | 0.20 | 1.20 | 0.13 |

Working Example 5-1

Preparation of Coating Liquid for Anchor Layer (2)

A coating liquid for an anchor layer (2) was prepared with the same method as in "Preparation of coating liquid for anchor layer (1)" of Working Example 1-1 described above.

Preparation of Coating Liquid for Thermosensitive Recording Layer

A coating liquid for a thermosensitive recording layer was prepared with the same method as in "Preparation of coating liquid for thermosensitive recording layer" of Working Example 1-1 described above.

Preparation of Coating Liquid for Protective Layer

A coating liquid for a protective layer was prepared with the same method as in "Preparation of coating liquid for protective layer" of Working Example 1-1 described above.

Production of Thermosensitive Recording Material

An anchor layer (2) was formed by applying and drying a coating liquid for an anchor layer (2) on a paper support having a weight of 50 g/m$^2$ and a surface roughness of 8 μm under a pressure of 20 kg/cm$^2$ measured by a microtopograph so that the coated amount after drying was 6.0 g/m$^2$. A thermosensitive recording layer was formed by applying and drying a coating liquid for a thermosensitive recording layer on the obtained anchor layer (2) so that the coated amount after drying was 3.0 g/m$^2$. Furthermore, a protective layer was formed by applying and drying a coating liquid for a protective layer on the thermosensitive recording layer so that the coated amount after drying was 2.5 g/m$^2$. The material was then smoothened with a super calender under pressurized conditions with a linear pressure of 78 N/m to obtain a thermosensitive recording material. The Stockigt sizing degree of the support was 10 seconds.

Working Example 5-2

A thermosensitive recording material was obtained in the same manner as in Working Example 5-1 with the exception that the amount of calcined kaolin was changed from 130 parts to 155 parts and that a plastic hollow particle dispersion was not used in the preparation of the coating liquid for the anchor layer (2) of Working Example 1.

Working Example 5-3

A thermosensitive recording material was obtained in the same manner as in Working Example 5-1 with the exception that the amount of calcined kaolin was changed from 130 parts to 62 parts and that the amount of the plastic hollow particle dispersion was changed from 48 parts to 176 parts in the preparation of the coating liquid for the anchor layer (2) of Working Example 1.

Working Example 5-4

A thermosensitive recording material was obtained in the same manner as in Working Example 5-1 with the exception that the amount of the styrene-acrylic-based emulsion-type sizing agent was changed from 12.8 parts to 3.3 parts in the preparation of the coating liquid for the anchor layer (2) of Working Example 5-1.

Working Example 5-5

A thermosensitive recording material was obtained in the same manner as in Working Example 5-1 with the exception that the amount of the styrene-acrylic-based emulsion-type sizing agent was changed from 12.8 parts to 30 parts in the preparation of the coating liquid for the anchor layer (2) of Working Example 5-1.

Working Example 5-6

A thermosensitive recording material was obtained in the same manner as in Working Example 5-1 with the exception that a paper support having a basis weight of 50 g/m$^2$ and a surface roughness of 15 μm under a pressure of 20 kg/cm$^2$ measured with a microtopograph was used instead of a paper support having a basis weight of 50 g/m$^2$ and a surface roughness of 8 μm under a pressure of 20 kg/cm$^2$ measured with a microtopograph in the production of the thermosensitive recording material of Working Example 5-1. The Stockigt sizing degree of the support was 7 seconds.

Working Example 5-7

A thermosensitive recording material was obtained in the same manner as in Working Example 5-1 with the exception that a styrene-maleic acid copolymer ammonium salt (trade name: Polymaron 385, manufactured by Arakawa Chemical Industries, Ltd., solids content concentration: 25%) was used instead of the styrene-acrylic-based emulsion-type sizing agent in the preparation of the coating liquid for the anchor layer (2) of Working Example 5-1.

Working Example 5-8

A thermosensitive recording material was obtained in the same manner as in Working Example 5-1 with the exception that the amount of calcined kaolin was changed from 130 parts to 110 parts and that the amount of the plastic hollow particle dispersion was changed from 48 parts to 90 parts in the preparation of the coating liquid for the anchor layer (2) of Working Example 5-1.

Working Example 5-9

A thermosensitive recording material was obtained in the same manner as in Working Example 5-1 with the exception that 1.8 parts of a dimethylolurea compound (trade name: Texapret R-S, manufactured by BASF, solids content concentration: 100%) was used instead of 4 parts of a 45% aqueous solution of a zirconium ammonium carbonate salt in the preparation of the coating liquid for the anchor layer (2) of Working Example 5-1.

Comparative Example 5-1

A thermosensitive recording material was obtained in the same manner as in Working Example 5-1 with the exception that a styrene-acrylic-based emulsion-type sizing agent was not used in the preparation of the coating liquid for the anchor layer (1) of Working Example 5-1.

The following evaluations were performed with the same methods as in Working Example 1 for the thermosensitive recording materials obtained as described above. The results are shown in Table 5.

TABLE 5

| | Recording performance 1 | | Recording performance 2 | | | |
|---|---|---|---|---|---|---|
| | Color developability | Image quality | Color developability | Reproduction rate | Evaluation | Image quality |
| Working Example 5-1 | 1.20 | ○ | 1.14 | 95% | ○ | ○ |
| Working Example 5-2 | 1.00 | Δ | 0.91 | 91% | Δ | Δ |
| Working Example 5-3 | 1.32 | ○ | 1.28 | 97% | ○ | ○ |
| Working Example 5-4 | 1.22 | ○ | 1.12 | 92% | ○ | ○ |
| Working Example 5-5 | 1.18 | ○ | 1.16 | 98% | ○ | ○ |
| Working Example 5-6 | 1.09 | Δ | 1.03 | 94% | Δ | Δ |
| Working Example 5-7 | 1.24 | ○ | 1.20 | 97% | ○ | ○ |

TABLE 5-continued

| | Recording performance 1 | | Recording performance 2 | | | |
|---|---|---|---|---|---|---|
| | Color devel-opability | Image quality | Color devel-opability | Repro-duction rate | Eval-uation | Image quality |
| Working Example 5-8 | 1.25 | ○ | 1.21 | 97% | ○ | ○ |
| Working Example 5-9 | 1.20 | ○ | 1.08 | 90% | ○ | ○ |
| Comparative Example 5-1 | 1.23 | ○ | 1.01 | 82% | X | ○ |

INDUSTRIAL APPLICABILITY

The thermosensitive recording material obtained by the present invention yields a thermosensitive recording material having high recording sensitivity, excellent image stability, good background fogging when stored at high temperatures, and no color defects after storage over time due to the effects of the adhesive component, so the thermosensitive recording material can be suitably used in label applications.

The invention claimed is:

1. A thermosensitive recording material comprising:

at least an anchor layer (1) containing a sizing agent and plastic hollow particles on a support;

an undercoat layer containing at least one member selected from the group consisting of plastic hollow particles and sizing agents on the anchor layer (1); and a thermosensitive recording layer containing a leuco dye and a coloring agent on the undercoat layer.

2. The thermosensitive recording material according to claim 1, wherein the undercoat layer contains the plastic hollow particles and the sizing agent.

3. The thermosensitive recording material according to claim 1, wherein the undercoat layer contains the sizing agent in an amount of 0.5 to 7 mass % in terms of solids content, based on the total solids content of the undercoat layer.

4. The thermosensitive recording material according to claim 1, wherein the undercoat layer contains the plastic hollow particles in an amount of 40 to 95 mass %, based on the total solids content of the undercoat layer.

5. The thermosensitive recording material according to claim 1, wherein the anchor layer (1) contains at least one member selected from the group consisting of oil-absorptive pigments and plastic hollow particles as a pigment, and the mass ratio of the plastic hollow particles in the anchor layer (1) to the plastic hollow particles in the undercoat layer is from 0/100 to 60/40.

6. The thermosensitive recording material according to claim 1 comprising at least one member selected from the group consisting of 4,4'-dihydroxydiphenylsulfone, 2,4'-dihydroxydiphenylsulfone, and sulfonylurea compounds as the coloring agent.

7. The thermosensitive recording material according to claim 1, wherein at least one layer formed on the support is formed by a curtain coating method.

8. The thermosensitive recording material according to claim 1, wherein the support further contains a basic pigment.

9. The thermosensitive recording material according to claim 1, wherein the support has an air permeability of 80 seconds or less.

10. The thermosensitive recording material according to claim 1, wherein the support is a paper support.

11. The thermosensitive recording material according to claim 1, wherein the support has a surface roughness measured with a microtopograph under a pressure of 20 kg/cm2 of at least 6 μm.

12. The thermosensitive recording material according to claim 1, wherein the support has a Stockigt sizing degree of at most 15 seconds.

13. The thermosensitive recording material according to claim 1 comprising an adhesive layer on a side of the support opposite to the thermosensitive recording layer side.

14. The thermosensitive recording material according to claim 1, wherein the anchor layer (1) is a pigment-coated layer.

15. The thermosensitive recording material according to claim 1, wherein the sizing agent contained in the anchor layer (1) is at least one member selected from the group consisting of styrene-acrylic-based sizing agents and styrene-maleic acid-based sizing agents.

16. The thermosensitive recording material according to claim 1, wherein the anchor layer (1) further contains a pigment and contains at least one member selected from the group consisting of oil-absorptive pigments and plastic hollow particles as the pigment, and the mass ratio of the oil-absorptive pigment to the plastic hollow particles in the anchor layer (1) is from 100/0 to 40/60.

17. The thermosensitive recording material according to claim 1, wherein the anchor layer (1) contains the sizing agent in an amount of 1 to 9 mass % in terms of solids content, based on the total solids content of the anchor layer.

18. The thermosensitive recording material according to claim 1, wherein at least the thermosensitive recording layer is a layer formed by a curtain coating method.

19. The thermosensitive recording material according to claim 1, wherein the sizing agent in the anchor layer (1) contains a styrene-acrylic-based emulsion-type sizing agent.

20. The thermosensitive recording material according to claim 1, wherein the undercoat layer contains a butyl ester of a styrene-maleic anhydride copolymer as the sizing agent.

* * * * *